US007490964B2

(12) United States Patent
Haddad et al.

(10) Patent No.: US 7,490,964 B2
(45) **Date of Patent: *Feb. 17, 2009**

(54) MODULAR POLE SYSTEM FOR A LIGHT FIXTURE

(75) Inventors: Eric O. M. Haddad, East Berlin, PA (US); Donald G. Fentress, Fulton, MD (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/426,382

(22) Filed: Jun. 26, 2006

(65) Prior Publication Data

US 2007/0247859 A1 Oct. 25, 2007

Related U.S. Application Data

(63) Continuation-in-part of application No. 11/052,450, filed on Feb. 7, 2005, now Pat. No. 7,090,382, and a continuation of application No. 10/267,416, filed on Oct. 9, 2002, now Pat. No. 6,851,838.

(51) Int. Cl.
*F21S 8/00* (2006.01)
*F21S 13/10* (2006.01)

(52) U.S. Cl. ..... 362/431; 362/414

(58) Field of Classification Search ..... 362/410, 362/414, 431; 40/607.01, 607.1; 52/726.3–726.4
See application file for complete search history.

(56) References Cited

U.S. PATENT DOCUMENTS

| | | | | |
|---|---|---|---|---|
| 114,513 | A | | 5/1871 | Aronson |
| 187,423 | A | | 2/1877 | Shirley |
| 194,402 | A | | 8/1877 | Barns |
| 357,217 | A | | 2/1887 | McCallip |
| 680,342 | A | | 8/1901 | Martin |
| 708,087 | A | | 9/1902 | Smith |
| 1,045,852 | A | | 12/1912 | Jones |
| 1,086,346 | A | | 2/1914 | Babrick |
| 1,095,197 | A | | 5/1914 | Entenmann |
| 1,140,192 | A | * | 5/1915 | Shaw ..... 362/431 |
| 1,201,108 | A | | 10/1916 | Smith |
| 1,456,314 | A | | 5/1923 | Key |
| 1,481,187 | A | | 1/1924 | Clay |
| 1,600,032 | A | * | 9/1926 | Barrick et al. ..... 52/295 |
| 1,776,682 | A | | 9/1930 | King |
| 1,903,907 | A | | 4/1933 | Riemenschneider |
| 1,906,508 | A | | 5/1933 | Arbogast |
| 2,209,580 | A | | 7/1940 | Sargent |
| 2,232,625 | A | | 2/1941 | O'Keeffe |
| 2,318,396 | A | | 5/1943 | Hoyt |
| 2,593,171 | A | | 4/1952 | Morse |
| 2,782,295 | A | | 2/1957 | Schwenkler |

(Continued)

*Primary Examiner*—Sandra O'Shea
*Assistant Examiner*—Jason Moon Han
(74) *Attorney, Agent, or Firm*—James E. Cole; Middleton Reutlinger

(57) ABSTRACT

A retro-fit lighting system includes a pole having a base plate at one end, the pole is disposed in a substantially upright orientation, a base cover disposed over the base plate and around the pole, at least one spacer positioned along the pole, a sleeve disposed over the pole, above said base cover and engaged by the at least one spacer, the sleeve having a length at least about half the length of the pole.

8 Claims, 22 Drawing Sheets

U.S. PATENT DOCUMENTS 2,791,241 A 5/1957 Reed
2,836,709 A 5/1958 Dusen, Jr.
3,083,796 A 4/1963 Bell, Jr.
3,094,238 A 6/1963 Davidson
3,096,029 A 7/1963 Berge
3,158,349 A 11/1964 Bergstrom
3,193,059 A 7/1965 Wallerstein, Jr.
3,194,427 A 7/1965 Mullett et al.
3,222,509 A 12/1965 Thedford
3,278,743 A 10/1966 Franck
3,325,950 A 6/1967 Pfaff, Jr.
3,328,579 A 6/1967 Green
3,335,534 A 8/1967 Hester et al.
3,343,322 A 9/1967 Lurkis et al.
3,362,737 A 1/1968 Cobb
3,369,331 A 2/1968 Deskey et al.
3,385,656 A 5/1968 Cuthbert
3,400,905 A 9/1968 Dusen, Jr.
3,403,520 A 10/1968 Goodman
3,410,995 A 11/1968 Gray
3,429,758 A 2/1969 Young
3,481,369 A 12/1969 Ganahl
3,563,502 A 2/1971 Dayson
3,603,717 A 9/1971 Scott
3,655,468 A 4/1972 Bastone et al.
3,671,738 A 6/1972 Beachley
3,803,400 A 4/1974 Ozawa
3,813,837 A 6/1974 McClain et al.
3,833,804 A 9/1974 Vesely
3,853,418 A 12/1974 Druin et al.
3,866,034 A 2/1975 Russo
3,886,024 A 5/1975 Chase
3,886,029 A 5/1975 Poulsen
3,896,858 A 7/1975 Whatley
3,974,372 A * 8/1976 Cochran ..... 362/431
4,028,542 A 6/1977 McReynolds, Jr.
4,048,360 A 9/1977 Jonda
4,070,567 A 1/1978 Crompton
4,089,727 A 5/1978 McLain
4,091,444 A 5/1978 Mori
4,142,227 A 2/1979 Aikens
4,166,537 A 9/1979 Fortunato
4,200,906 A 4/1980 Santilli
4,201,823 A 5/1980 Russell
4,246,732 A 1/1981 Frehner
4,262,047 A 4/1981 Barnett et al.
4,269,010 A 5/1981 Glass
4,319,312 A 3/1982 de Vos et al.
4,336,868 A 6/1982 Wilson et al.
4,343,567 A 8/1982 Sarver et al.
4,381,960 A 5/1983 Pinter et al.
4,388,787 A 6/1983 Milbright
4,395,750 A 7/1983 Scheidemann et al.
4,445,163 A 4/1984 Ziaylek, Jr.
4,462,068 A 7/1984 Shadwick
4,471,411 A 9/1984 Graham et al.
4,488,696 A 12/1984 Sauber
4,523,263 A 6/1985 Poyer
4,548,377 A 10/1985 Huel
4,564,890 A 1/1986 Poyer
4,617,768 A 10/1986 Gebelius
4,621,662 A 11/1986 Olry
4,622,086 A 11/1986 Puck et al.
4,658,335 A 4/1987 Culler
4,701,577 A 10/1987 Bourrieres
4,705,425 A 11/1987 Okawa
4,784,351 A 11/1988 Eickmann
4,803,819 A 2/1989 Kelsey
4,858,877 A 8/1989 Carter
4,920,715 A 5/1990 Parsons et al.
4,921,557 A 5/1990 Nakamura
4,947,307 A 8/1990 Quiogue
4,951,182 A 8/1990 Simonson et al.
4,969,074 A 11/1990 Davis et al.
4,972,301 A 11/1990 Kasboske
5,028,464 A 7/1991 Shigetoh
5,040,917 A 8/1991 Camuffo
5,055,987 A 10/1991 Ellson et al.
5,060,437 A 10/1991 Parsons et al.
5,062,029 A 10/1991 Engel
5,081,569 A 1/1992 Quiogue et al.
5,086,379 A 2/1992 Denison et al.
5,099,405 A 3/1992 Gehly et al.
5,183,330 A 2/1993 Rishel et al.
5,197,819 A 3/1993 Hughes
5,220,744 A 6/1993 Kendall
5,228,260 A 7/1993 Dziedzic
5,274,537 A 12/1993 Altman
5,289,358 A 2/1994 Halemeier
D348,745 S 7/1994 Ewing et al.
5,398,180 A 3/1995 Lee
5,433,333 A 7/1995 Martell
5,492,579 A 2/1996 Hosford et al.
5,499,885 A 3/1996 Chapman
5,504,397 A 4/1996 Chien
5,505,036 A 4/1996 Wiles
5,513,477 A 5/1996 Farber
5,572,846 A 11/1996 Sosa
5,625,988 A 5/1997 Killick
5,701,236 A 12/1997 Viviano
5,704,187 A 1/1998 Hosford et al.
5,704,580 A 1/1998 Peery, Jr.
D390,994 S 2/1998 Ewing et al.
D390,995 S 2/1998 Ewing et al.
D391,383 S 2/1998 Ewing et al.
5,761,875 A 6/1998 Oliphant et al.
5,775,035 A 7/1998 Papin
D400,277 S 10/1998 Ewing et al.
5,833,351 A 11/1998 Marsh
5,870,877 A 2/1999 Turner
5,887,856 A 3/1999 Everly, II
5,918,849 A 7/1999 Bliss
5,941,485 A 8/1999 Davidson et al.
5,954,426 A 9/1999 Whittington
6,027,228 A 2/2000 Adams et al.
6,033,089 A 3/2000 Tesauro
6,152,579 A 11/2000 Reed et al.
6,155,017 A 12/2000 Turner
6,164,803 A 12/2000 Reniger et al.
6,167,673 B1 1/2001 Fournier
6,240,689 B1 6/2001 Haddad et al.
6,322,863 B1 11/2001 Kubicky
6,327,833 B1 12/2001 Miskelley et al.
6,363,644 B1 4/2002 Frost
6,389,760 B1 5/2002 McDonnell
6,585,398 B1 7/2003 Haddad
6,851,838 B2 2/2005 Haddad et al.
RE38,767 E 8/2005 Wedell et al.

* cited by examiner

MODULAR POLE SYSTEM FOR A LIGHT FIXTURE

CROSS REFERENCE TO RELATED APPLICATION

This application is a continuation-in-part application of a co-pending continuation patent application Ser. No. 11/052,450, filed Feb. 7, 2005, which claims priority from patent application Ser. No. 10/267,416, filed Oct. 9, 2002, now U.S. Pat. Ser. No. 6,851,838.

BACKGROUND OF THE INVENTION

1. Technical Field of the Invention

The present invention relates to a modular pole system which supports a light fixture, the modular pole system having a decorative non-load bearing outer cover encasing a load bearing inner skeleton which may also act as a passive defense mechanism.

2. Review of the Prior Art

Full length lighting standards have been utilized in the prior art and are typically made of cast iron or other metallized product throughout. Problematic with these designs is the weight of the overall lighting standard and the difficulty in casting the iron in the proper decorative format. Further difficulties involved with utilizing decorative metal lighting standards is the degradation of appearance due to environment or other external factors. Thus, after extended periods of use, previously known ornamental lighting standards tend to show increasing wear, become problematic for repair, are fairly expensive from a manufacturing point of view, and overall tend to be inefficient in the use of materials. Additional problems with prior art ornamental lighting standards exist in that they have previously further been utilized in segmented form due to their weight, wherein multiple segments are added upon each other to create the upwardly extending lighting standard. Such weight issues required extensive lifting machinery to install the standard, exceptionally strong anchoring bolts to ensure vertical stability, affixation brackets necessary to attaching the fixture directly to the standard or metallized external portion of the standard and other structural enhancements and support for maintaining the standard in proper upright and stable form.

An additional problem with the prior art lighting standards exist in the vulnerability for the lighting standards to be collapsed or even destroyed after impact from an automobile or other heavy vehicle. It may therefore be desirable to combine both a lightweight decorative unitary structure forming an ornamental lighting standard with an internal skeletal structure which may combine to perform as a passive defense measure. None of the prior art decorative lighting standards provide a sufficient decorative lightweight appearance in combination with a strengthened structural support which may form a passive defense measure.

SUMMARY OF THE INVENTION

The modular pole system for a light fixture of the present invention solves the drawbacks and deficiencies of prior art decorative lighting standards in that the decorative lighting standard of the present design is a modular system comprised of a load bearing internal skeletal structure having a steel base plate and support tube in combination with a non-load bearing decorative lightweight exterior shell which, when used in combination, performs as a static structure which may act as a passive defense measure while also providing a unique decorative lighting standard.

It is an object of the present invention is to provide a decorative and ornamental lighting standard which is modular in design and which has a lightweight decorative non-load bearing exterior shell supported on a load-bearing internal skeletal structure, the internal skeletal structure modified so as to be affixed to the lighting fixture and have a strengthened base plate and base tube or post.

It is another object of the present invention to provide a modular pole system for a light fixture which creates an ornamental lighting standard acting as a passive defense measure.

It is a further object of the present invention to provide an ornamental decorative lighting standard which is a static structure which is strong enough to impede the path of cars, sport utility vehicle or other light to medium vehicles as well as larger or heavier transports while also providing a decorative exterior support for a light fixture.

An even further object of the present invention is to provide an ornamental lighting standard which has an ornate external non-load bearing high impact plastic shell which masks the load bearing structural support and steel base plate contained there beneath.

A further object of the present invention is to take advantage of the durability of plastics and other polymers for creation of an ornamental external lighting standard and combining such an exterior structure with an internal load bearing skeletal structure and base which performs as a defensive steel base and post preventing vehicles and other transports from overrunning the ornamental lighting standard.

It a further object of the present invention to combine the internal strength of the steel or aluminum load bearing understructure with the external aesthetic surface of a molded plastic design wherein the external decorative plastic is a non-load bearing slipover one piece cover.

The modular pole system for light fixtures of the present invention combines an external ornamental lighting standard which is plastic, the plastic being molded to color wherein the color runs through the entire product and wherein the internal load bearing skeleton structure over which the shell slips is constructed of a tapered aluminum or galvanized steel pole which rests in a unitary galvanized steel base plate and base tube or post. The non-load bearing external shell may be constructed of a polymer which is resistant to environmental degradation and abrasion resistant while further having a strength exceeding typical epoxy, common nylon or PVC. The modular pole system for a light fixture of the present invention further has a load bearing internal skeleton structure affixed to the light fixture at a top end and which may be made of galvanized steel wherein the galvanized steel base and base tube support a tapered aluminum or galvanized steel pole, the plastic shell slipping over a tapered or non-tapered pole. The steel base plate is of sufficient width to support the entire structure while also acting as a passive defense measure maintained within a static structure which prevents vehicles from passing over the whole system.

These and other objects are met by the modular pole system for a light fixture of the present invention.

All of the above outlined objectives are to be understood as exemplary only and many more objectives of the invention may be adapted from the disclosure herein. Therefore no limiting interpretation of the objectives noted are to be understood without further reading of the entire specification, claims and drawings included herewith.

DESCRIPTION OF THE FIGURES

A better understanding of the modular pole system for light fixture of the present invention may be had by reference to the attached drawings, wherein like numerals referred to like elements and wherein.

DETAILED DESCRIPTION OF THE PREFERRED EMBODIMENT

Figure 1:
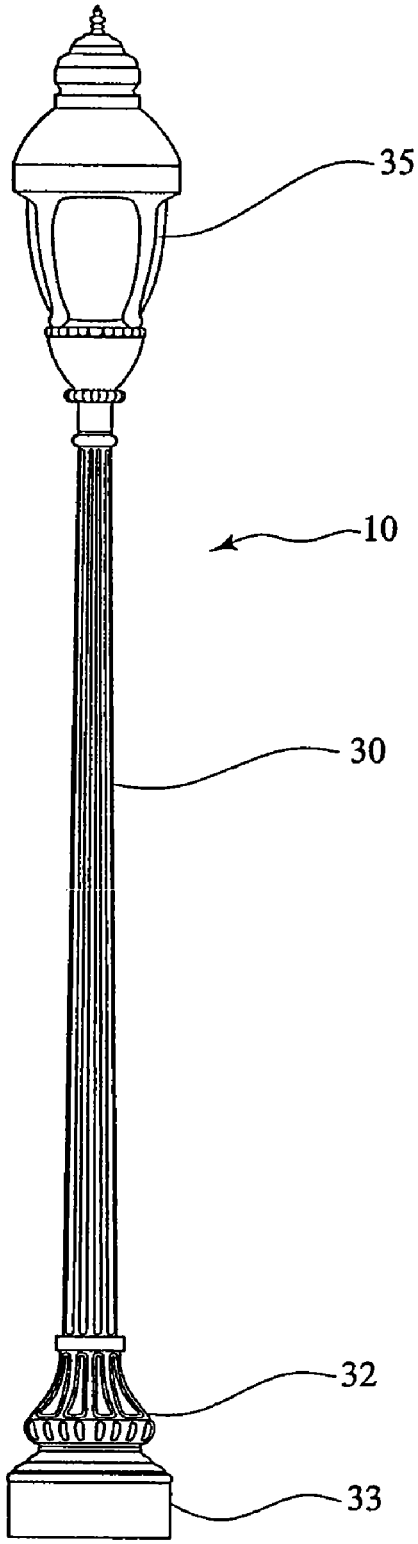
FIG. 1 is a front view of the modular pole system and light fixture of the present invention.

The modular pole system and light fixture 10 of the present invention is shown in FIG. 1. As can be seen from the external surfacing therein, the modular pole system 10 of the present invention is constructed on its exterior surface of a light fixture 35, a non-load bearing decorative shell 30, a shell base 32 and a shell base cover 33, all of which may be unitary in construction. From its exterior appearance, the modular pole system and light fixture 10 of the present invention appears to be constructed of standard aluminum or steel finish with typical ornamental surfacing on the support pole which extends downward from the bottom end of the light fixture 35. Thus, the decorative non-load bearing shell 30 may have fluting, decorative finishes, ornamental appearance and coloring that are typically found in normal light support pole systems. Additionally, the shell base and base cover 32 and 33 may similarly be colored and have decorative finishes which are normally found in typical metalized products. Upon closer inspection however, the exterior covering of the modular pole system 10 of the present invention discloses that the vertically extending shell, shell base and base cover 30, 32 and 33 are constructed of a high durability and resilient unitary plastic structure which extends from the base cover to the bottom end of the light fixture 35. Such a unitary construction allows for easy assembly and installation with the lightweight exterior readily installable over an internal load-bearing support skeleton or skeletal structure 10*a*.

The decorative non-load bearing external shell 30 for the modular pole system 10 of the present invention is made of a single shell plastic which extends upward from a base cover 33 and which ends adjacent to the light fixture 35. The high impact plastic is molded into the shape of a vertically extending pole and shell base cover and provides an extremely high level of ultra-violet and environmental protection as compared to prior aluminum, steel or other metalized products. The external shell 30 additionally is a decorative shell which slips over the internal load bearing support skeleton 10*a* and does not support any load from the light fixture or other parts of the system. These plastics offer environmental and corrosion resistance, abrasion resistance, salt spray resistance and a strength which typically exceeds those of prior art epoxy, nylon, PVC or other fielded materials. The plastics, while providing a high level of environmental corrosion resistance, additionally provide coloring and do not require painting on their exterior surface. The shells which form the exterior surface may be molded to color with the selected hue running through the entire shell product. The decorative shell 30 can be molded for the vertically extending pole and shell base and base cover as a single unit in any defined or required texture or contour and may also be constructed of non-modular units.

Figure 2A:
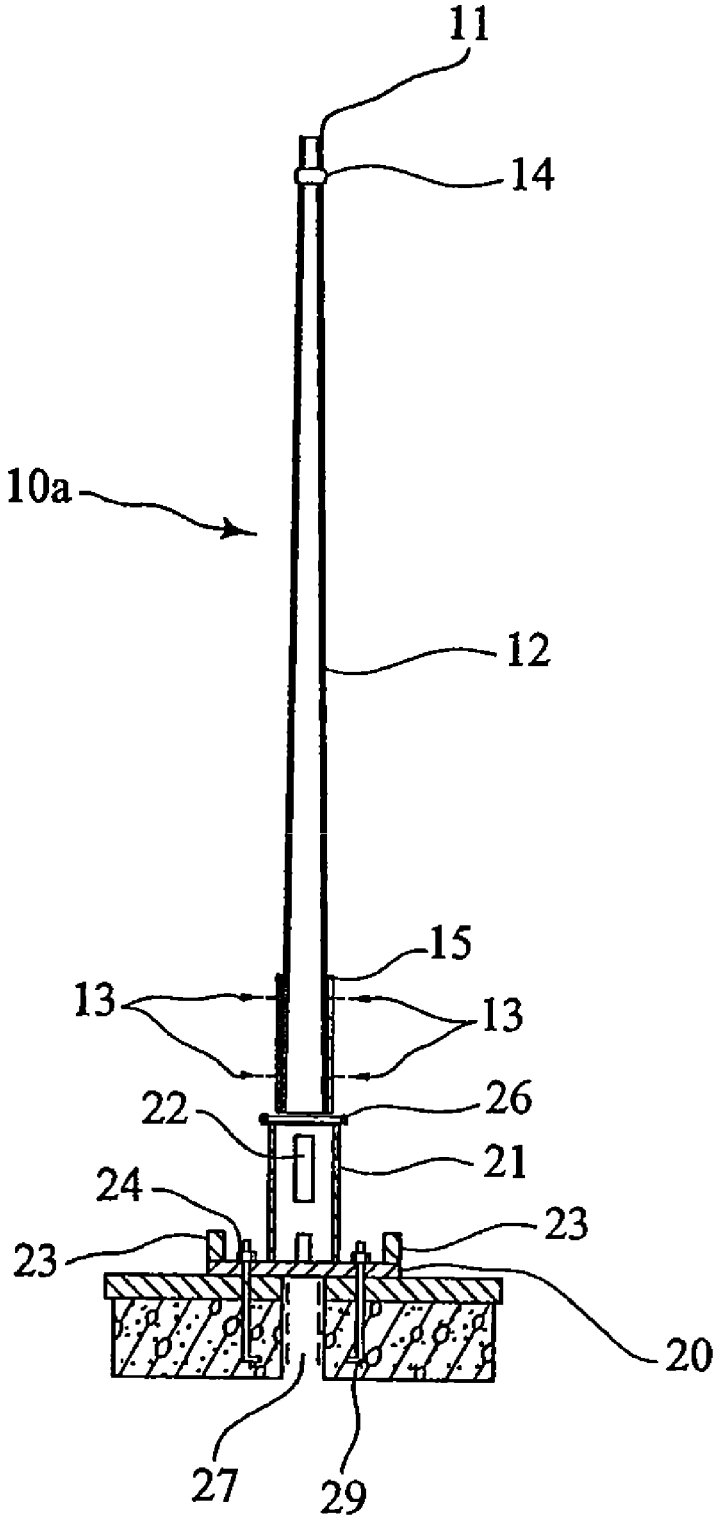
FIG. 2*a* is a side view of the internal skeletal structure of the pole system set forth in FIG. 1.

As depicted in FIG. 2*a*, the underlying skeletal structure 10*a* for the modular pole system 10 of the present invention is constructed of a tapered pole 12 which fits into a post 21 extending upward from the post base 20. The internal skeletal structure 10*a* is a load bearing skeletal structure which supports the weight of the light fixture 35 and also of the shell 30.

As depicted in FIG. 2*a* in partially unassembled form, the tapered pole 12 may be made of an aluminum shaft and may slip into the post 21 and base 20. Post 21 and base 20 may be constructed of a galvanized solid steel product for increasing the strength of the underlying internal skeletal structure 10*a*. Such a construction mates the high impact plastic of the decorative external shell 30 with the structural integrity of the aluminum or steel pole 12 and steel base and post 20 and 21. Alternatively, the internal skeletal structure 10*a* may be a unitary load bearing support structure which is surrounded by the external decorative shell 30.

As depicted, the pole 12 tapers slightly as it extends upward to a load bearing upper end where collar 14 is positioned in order to add stability to the exterior plastic shell 30 while also preventing movement thereof. The upper end 11 of the pole also provides a positioning area for anchoring of the light fixture 35. The upper end 11 of the pole 12 is directly affixed to the fixture 35.

As seen in FIG. 2*a*, the tapered pole 12 may have at its lower end a slip fitter 15 which may surround the lower end of the pole 12 and which allows the pole 12 to securely rest within the steel post 21 and be secured therein by set screws 13. The slip fitter thus may allow for insertion of up to 6 set screws which may be placed along two tiers at 120° in order to secure the pole 12 into the post 21. Other securing mechanisms may be utilized however to secure the pole 12 into post 21 which may include direct insertion and friction fit.

Access to the wiring which runs up through the conduit through the ground and inside the interior of the pole 12 may be provided through two aligned access openings 22 which are formed in the slip fitter 15 and the lower portion of the tapered pole 12, each of which may be rotated prior to assembly in order to match up with each other. The access opening 22 thereby provides access to the hollow interior of the pole 12. The post 21 may or may not have access opening formed therein, the non-inclusion of which may increase the structural rigidity of the post 21.

Figure 2B:
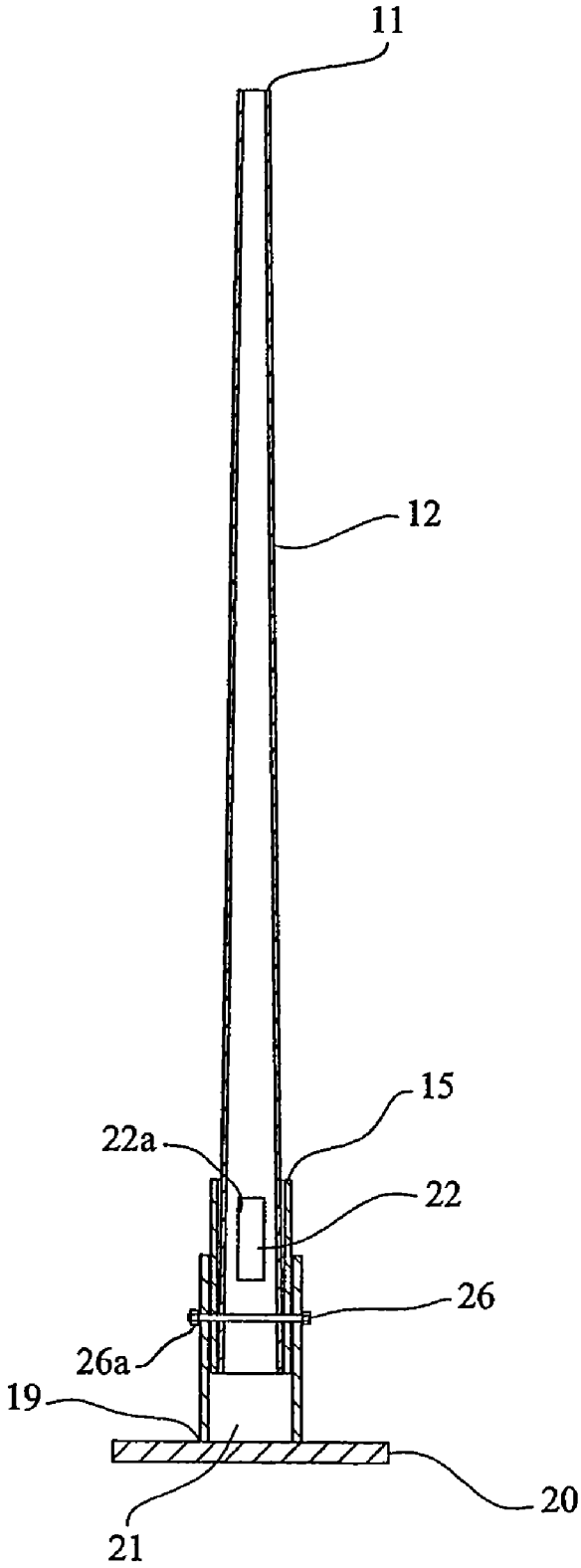
FIG. 2*b* is a partial side sectional view of the internal skeletal structure shown in FIG. 2*a* fully assembled.
Figure 4:
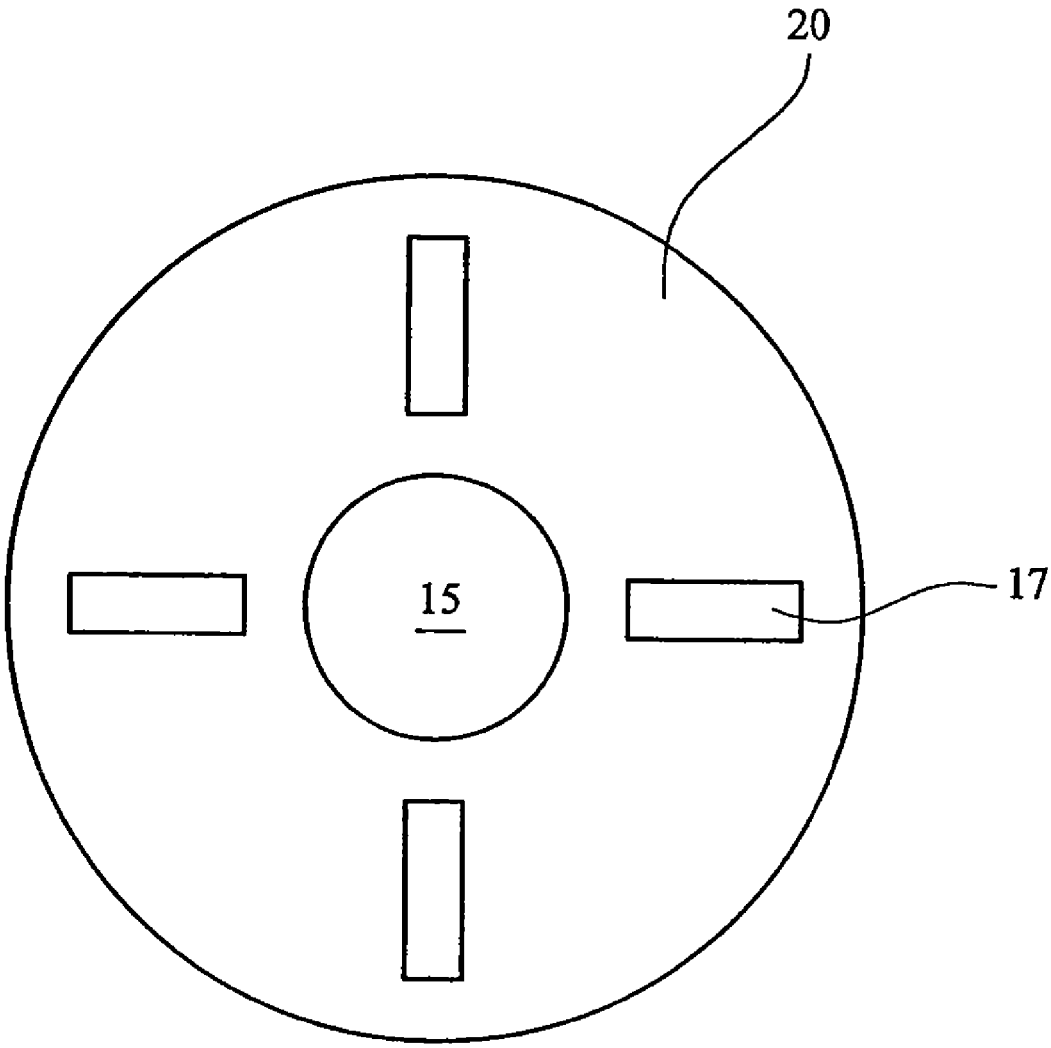
FIG. 4 is a top view of the base plate for use with the modular pole system of the present invention.

As can be seen in combination with FIG. 2*a* and FIG. 2*b*, the tapered pole 12 and slip fitter 15 are inserted into the open end of the post 21 in order to secure the internal skeleton 10*a* upright. The hollow interior 22*a* of the tapered pole 12 may contain the wiring for electrical connection of the light fixture 35 through the conduit opening 27 and conduit aperture 15 formed in the steel base 20 as depicted in FIG. 4. The tapered pole 12 may be secured into the post 21 by the cross bolt 26 which may be a one inch diameter cross bolt running through all three elements, namely the post 21, slip fitter 15 and tapered pole 12. Cross bolt 26 may be secured at its opposite end by a double nut affixation mechanism to properly secure the upright positioning of the structure of the modular pole system 10 of the present invention.

As also depicted in FIG. 2*a*, the steel base 20 is secured to the ground by a plurality of bolts 24 which affix to anchor rods 29 inserted into the ground and which extend through the steel base 20. Steel base 20 has at its center conduit aperture 15 which aligns with conduit opening 27 in the ground for wiring of the light fixture 35. Anchor rods 29 extend downward through the ground and are affixed to the steel base through slotted openings 17. Additionally, while not shown in FIG. 4, a plurality of upwardly extending prongs 23 may be provided along the periphery of the steel base. The steel base 20, as shown, may have four slotted openings 17 in order to receive up to one inch anchor bolts 24 securing the anchor rods 29 which allow it to be oriented to fit atop existing anchor rods. The steel base 20 may have a diameter of 18 inches with a conduit opening 15 centrally located therein of about 4¾ to 5 inches. However, as can be appreciated, a number of configurations may be utilized for the steel base 20 utilized herein.

The steel base 20 and post 21 are a unitary structure and the post 21 may be welded to the base 20 if needed. The tapered pole 12 which extends into the post 21 may taper, for example, from upper diameter of 3 inches to a lower diameter of 5 inches.

The prongs 23 which are found on the periphery of the steel base may be positioned around the outer edge of the base 20 in order to capture the plastic shell 30 and in particular securely compress outward against the base cover 33 in order to add stability to the slip over shell 30. As can be appreciated from FIG. 2*b* and FIG. 3, once the internal skeletal structure 10*a* of the modular pole system 10 of the present invention is in place, the shell 30 can be slid over the top of the internal skeletal structure in its entirety and locked into place between the fixture 35 at the upper end 11 of pole 12 and ground when the light fixture 35 is added at the top of the tapered pole. The prongs 23 and the collar 14 may optionally be included and serve to secure the shell 30 from any side to side movement while the fixture 35, when added to the top end 11 of the load bearing pole 12 with its own set screws, sandwiches the shell 30 in place between the ground thereby securing the shell in place without any required fasteners.

The external shell 30 has a shell base 32 and base cover 33 at the lower end thereof. The base cover 33, as better shown in FIG. 3, has a continuous interior surface. By continuous interior surface it is meant that the inner surface thereof does not extend inwardly, as in a flange or other attachment tab, for connection to said base 20 or to anchor rods 29. As such, it is apparent that by having a continuous interior surface, the base cover 33 does not require assembly directly to the base 20 or post 21. By having a continuous interior surface, the base cover 33 may simply be slid over the entire internal skeletal structure of the modular pole system and particularly over the base 20 without any assembly steps. Such a feature is particularly useful when assembling the modular pole system described herein or replacing older street lighting thereby allowing for the internal skeletal structure to be assembled and the shell to be readily slid down over the top of the skeletal structure. Of course, optional affixation mechanism may be utilized to secure the non-load bearing decorative shell 30 to the load bearing support skeleton 10*a*.

Figure 10:
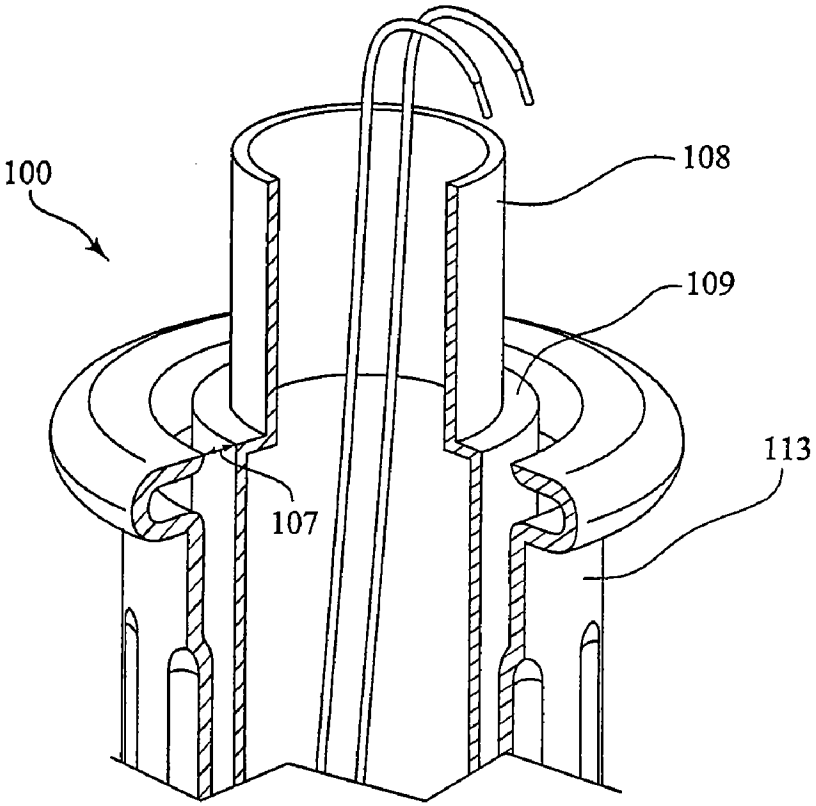
FIG. 10 is an additional side sectional view of the support pole and slip over cover embodiment of the present invention.
Figure 9:
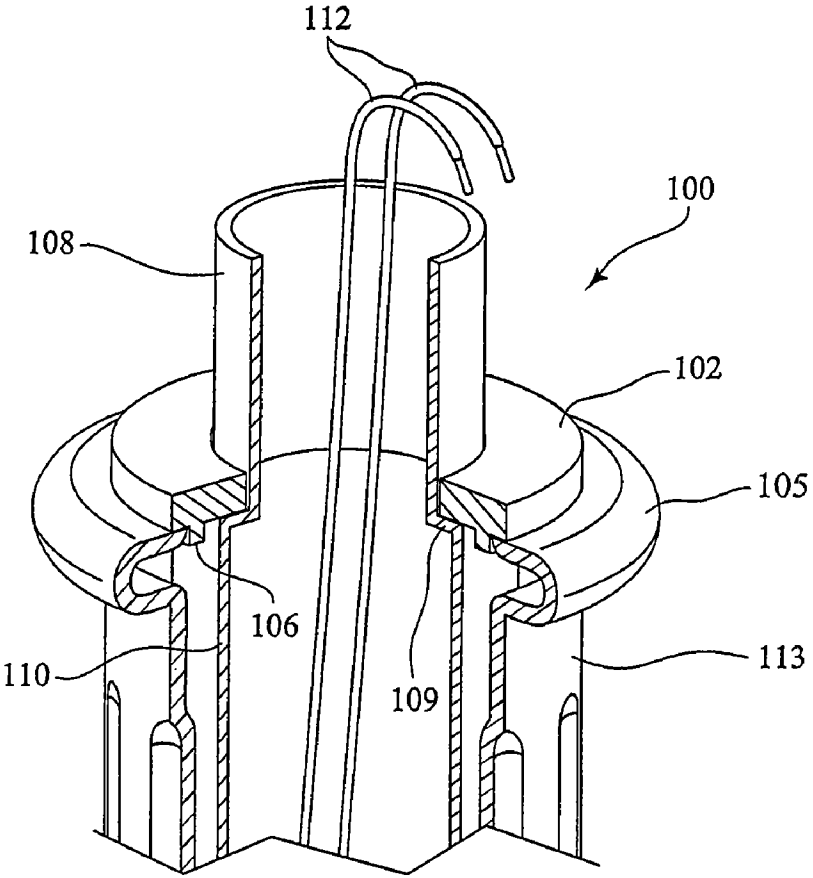
FIG. 9 is an additional side sectional view of the support pole and slip over cover embodiment of the present invention.
Figure 11:
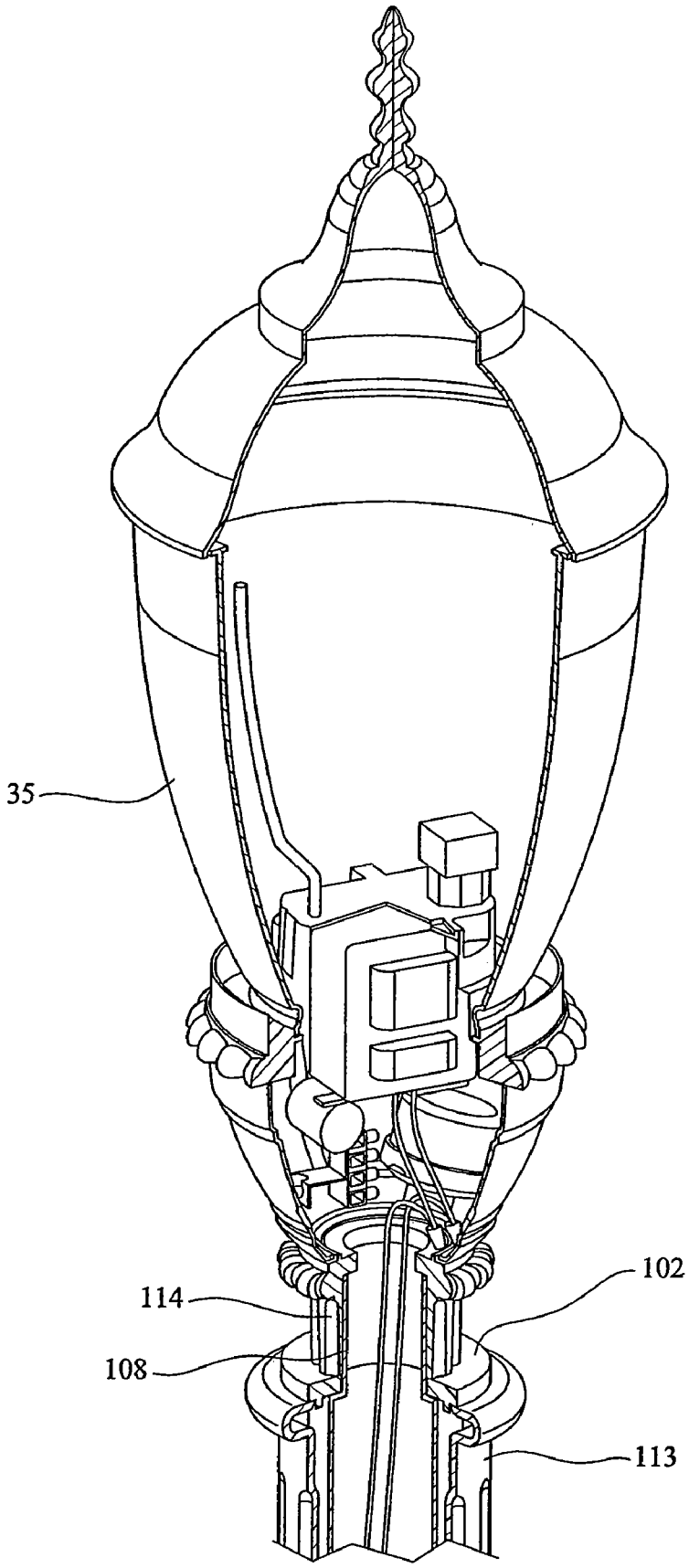
FIG. 11 is a sectional view of an additional embodiment of the module pole system of the present invention.

Installation of the fixture 35 is shown in FIGS. 9, 10 and 11 wherein fixture attachment 100 includes shell 113 which is shown extending upward to an upper end just below pole head 108 thereby exposing the pole head for affixation to fixture 35. Shell 113 extends upward to end 105 which may be aligned with tenon 109 of support pole 110. Shell 113 may be spaced from pole 110 by gap 107 so that it may be slipped over the top of the pole and installed readily. Gap 107 between the end 105 and tenon 109 may be closed by sleeve cap 102 which may rest upon an upper surface of end 105 and tenon 109. Sleeve cap 102 may be provided with spacer 106 to firmly separate the sleeve from the pole. Pole head 108 is exposed with wires 112 extending upward for electrical connection to fixture 35. While the support pole 110 shown has tenon 109, variations in the design of the upper end of the support pole 110 and the shell 113 may be provided for the ready attachment of the fixture to the pole 110 and the example shown is for explanatory purposes and not deemed to be limiting.

As displayed in FIG. 11, the fixture 35 is placed atop the pole head 108. Attachment cuff 114 of the fixture 35 is slid over exposed pole head 108 in order to attach the fixture to the pole and secure the shell in place. Pole head 108 provides sufficient exposed area for direct or indirect attachment of the fixture 35. As shown, sleeve cap 102 may remain exposed or, alternatively, may be covered by a lower end of the cuff 114. While the embodiment shown details fixture cuff 114 telescoping over the exterior of the pole head 108, many alternative affixation mechanisms may be provide such as inverted telescoping of the cuff 114 into the interior of the support pole or pole head.

Figure 12:
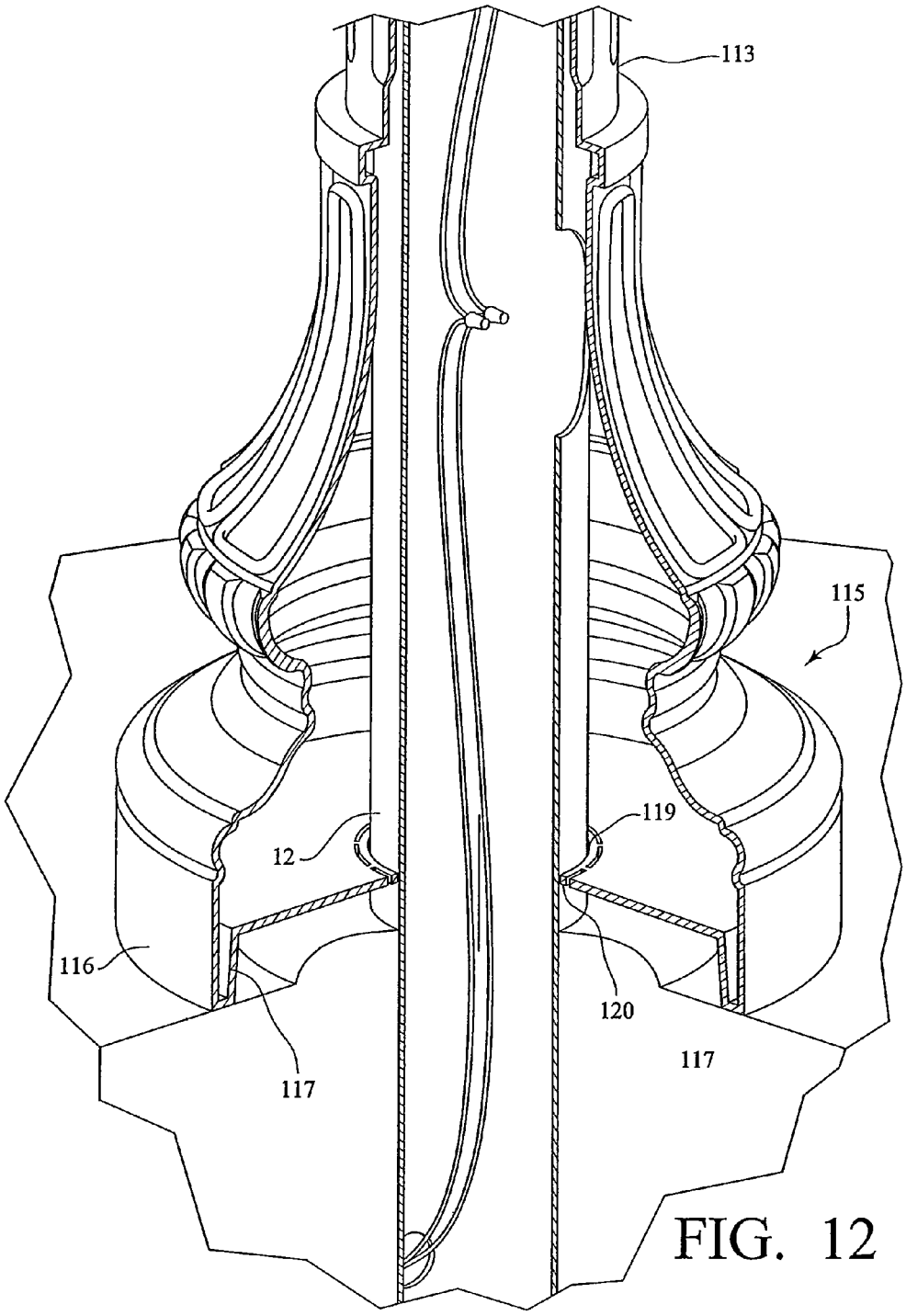
FIG. 12 is a side sectional view of an additional embodiment of the base portion of the slip over cover and internal support pole of the present invention.

FIG. 12 discloses an additional embodiment for installation of the support pole 12 and connection between base 116 thereof. As depicted, the shell-pole connection 115 may include the ability to merely slide the shell over the top of the support pole 12 and downward until the base 116 rests on the ground. Planar interior base 117 may extend inwardly towards pole 12 and may have a plurality of perforations 120 for adjustment of the shell interior aperture 119. Thus, shell 113 can appropriately be sized for varying diameter poles 12 and adjusted as required. Pole 12 extends downward through said interior aperture 119 and, in this embodiment, directly into the ground for securement of the pole in the vertical position.

Figure 6:
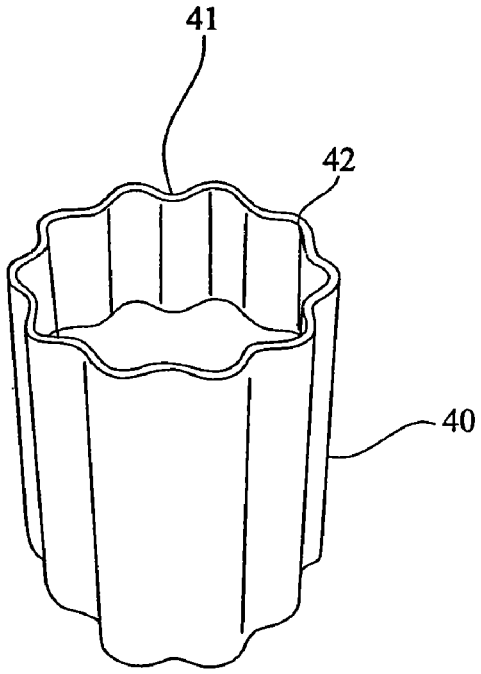
FIG. 6 is a perspective view of a anti-rotational mechanism for use in combination with the module pole system of the present invention.
Figure 7:
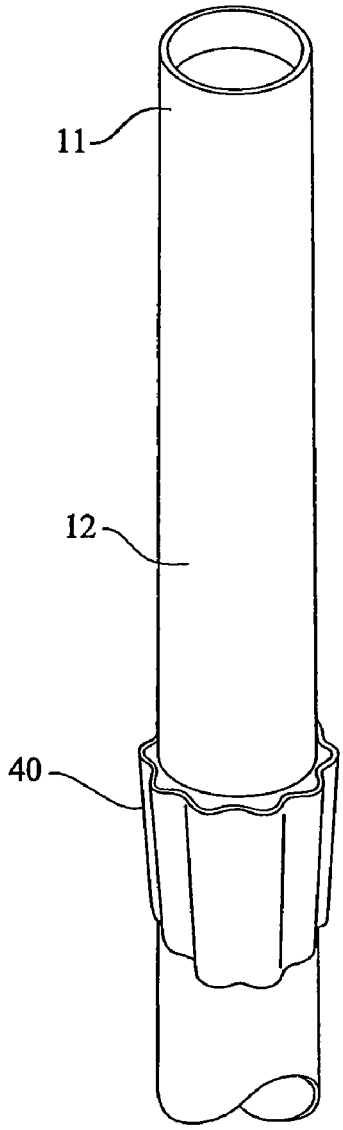
FIG. 7 is a perspective close-up view of the anti-rotational mechanism in stalled on the skeletal support pole of the present invention.
Figure 8:
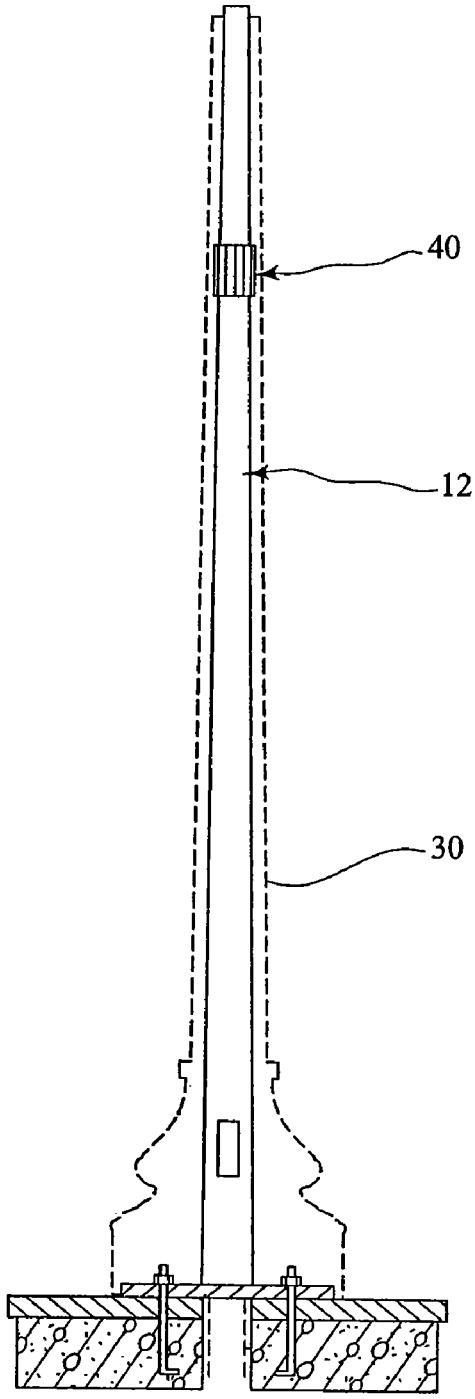
FIG. 8 is a side sectional view of the pole system of the present invention utilizing the non-rotational device of FIG. 6.

Additionally, as shown in FIG. 6-8, an anti-rotational device 40 may be installed over the pole 12 in order to secure and prevent rotation or other movement of the decorative shell 30. Anti-rotational device 40 may be a metal collar which has a series of flutes and ridges 41, 42 which allow the device 40 to slide over the upper end of the pole 11 and slide wedge into a predetermined position before the interior diameter prevents further downward travel on pole 12. Flutes and ridges 41, 42 prevent rotational movement of the device on the pole and also may be utilized to mate with the inner surface of the shell 30. Thus, the anti-rotation device 40 locks the non-load bearing shell 30 in proper position and prevents further movement of the shell either rotationally about the support skeleton 10*a* or vertically thereon.

The post and post base 21 and 20 may be secured together by a seam or weld 19 as depicted in FIG. 2*b* to insure that the integrity of the structure is maintained. The post 21 may extend upwards to a height of approximately 14 inches. Such a height will secure the tapered pole 12 in position while also maintaining structural integrity of the modular pole system 10 of the present invention.

Figure 3:
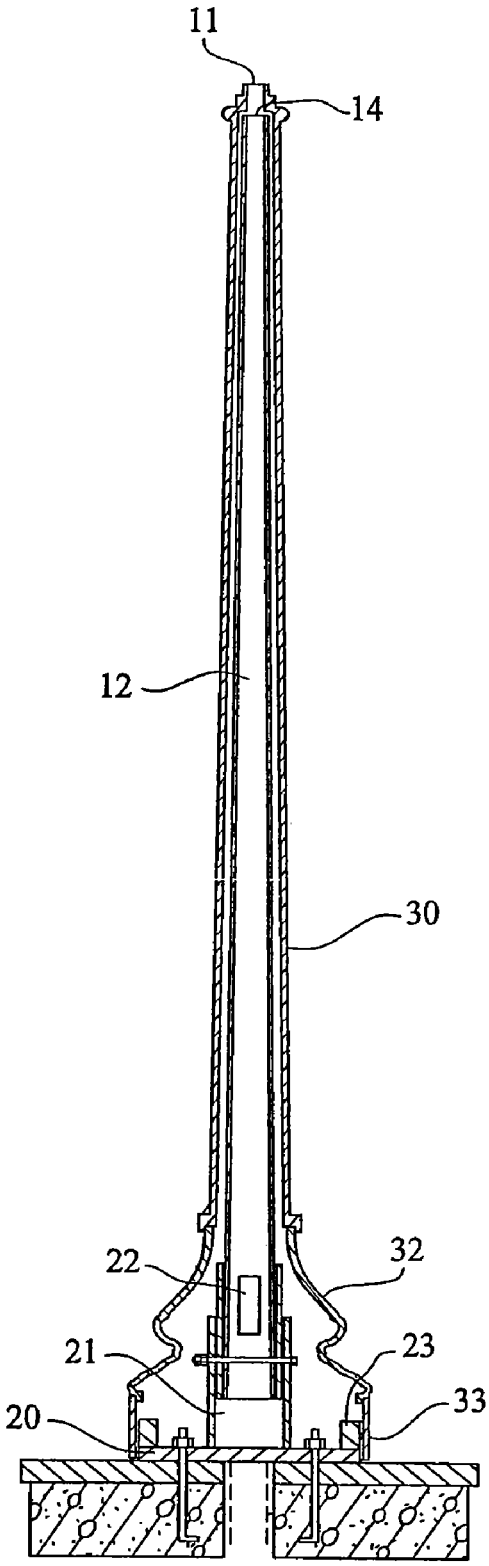
FIG. 3 is a representative side sectional view of the modular pole system shown in FIG. 1.

As shown in FIG. 3, the assembled modular pole system 10 of the present invention is depicted wherein the internal skeletal structure is comprised of the tapered pole 12, post 21 and post base 20. As shown therein, the post base 20 is secured to the ground by anchors 29 while the plurality of prongs 23 secure the base cover 33 in position by outward pressure or direct contact to base cover 33. Capture or securing prongs 23 may be utilized to abut against the base cover 33 and provide outward placement pressure on the base cover 33 to assure that the external shell 30 remains in correct position. Prongs 23 may be placed along the peripheral edge of the base 21, on the top surface as shown or extending outwardly from the side edge. Such variations in the design are considered to fall within the teachings set forth herein. The shell base and base cover extend downwardly from the vertical portion of the shell 30, all of which are integral such that the entire shell extending from the collar 14 downward to the prongs 23 may be slipped over the internal skeletal structure depicted. The design set forth therefore allows for the secure affixation of the shell 30 and is therefore accomplished without any fasteners.

As additionally seen from FIG. 1 and FIG. 3, the light fixture 35 is directly attached to the load bearing support skeleton 10*a* by attachment directly to the upper end 11 of the support pole 12. As shown, the pole 12 extends upward past the upper end of the decorative non-load bearing shell 30 thereby exposing the upper end 11. Exposed upper end 11 of the load bearing pole 12 and support skeleton 10*a* allows for the direct affixation of the light fixture 35 to the pole and support skeleton. Thus, the pole 10, which may be viewed as an integral portion of the support skeleton 10*a* since, after construction, all pieces are firmly affixed together, supports the entire weight of the fixture 35 and the decorative shell 30 is merely compressed between the fixture 35 and the ground. The fixture 35 may be secured to the upper end 11 of pole 12 by set screws, friction fit, clamps and other mechanism well known in the art.

The design of the system 10 of the present invention allows for easy installation and retrofit of previously existing standards. Particularly, since the shell 30 is of a lightweight design, it may be installed over the exterior of the support skeleton 10*a* with relative ease while assuring the rigidity of the device by the underlying structure. The exterior appearance can be constructed out of a number of lightweight materials as the design set forth herein does not necessarily require the decorative external shell to support the weight typically required for lighting standards. As set forth in one embodiment herein, the fixture 35 is directly affixed to the underlying skeletal structure and does not require support from the external portion of the standard.

Figure 5:
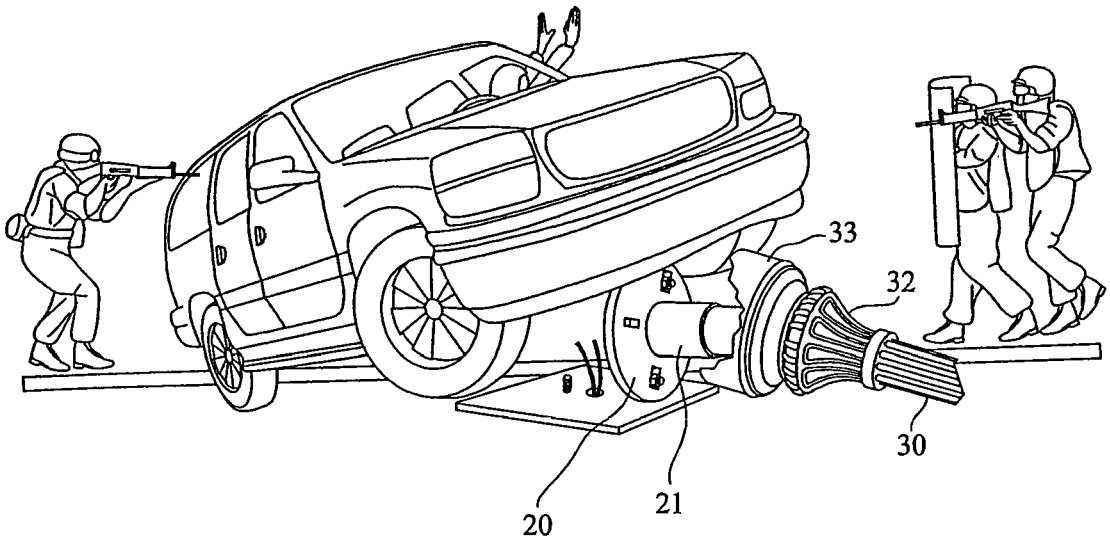
FIG. 5 is a perspective view of the modular pole system for light fixture of the present invention and use.

As constructed, the modular pole system 10 of the present invention may also provide a passive defense measure in that the rigid internal skeletal structure may provide a significant defensive measure thereby preventing intrusion of vehicles and the like due to the base plate 20 and post 21. As shown, the base 20 is anchored to the ground by a plurality of anchor bolts 24 and anchor rods 29. While standard street light fixtures, even when constructed of metalized framework, are affixed to the ground in order to assure their vertical stability, prior art lighting standards are not designed for significant structural rigidity to prevent vehicular assault. The design of the present invention may be utilized such that if a vehicle were to overrun the modular pole system and light fixture 10 of the present invention, it would be prevented from further advancement due to the galvanized steel base and post design set forth herein. Thus, the defensive measure aspect of the present invention may mask a vehicular intrusion security system with a decorative external plastic lighting standard which, to all external appearance, does not have significant rigidity necessary for a vehicle intrusion security system as described herein. However, the internal skeletal framework comprised of the 18 inch round base which is securely anchored to the ground, will provide a static defense to vehicular assault. The design may be utilized to halt lighter vehicles. If a vehicle were to attempt to overrun the modular pole system and light fixture 10 of the present invention as shown in FIG. 5, the vertical post 21 would tip forward under the weight of the forward movement of the vehicle. As the post 21 and base 20 are integral, this action would also cause the base 20 to flip upward thereby catching the underside of the vehicle chassis and potentially hanging the vehicle up to prevent additional forward movement.

Figure 13:
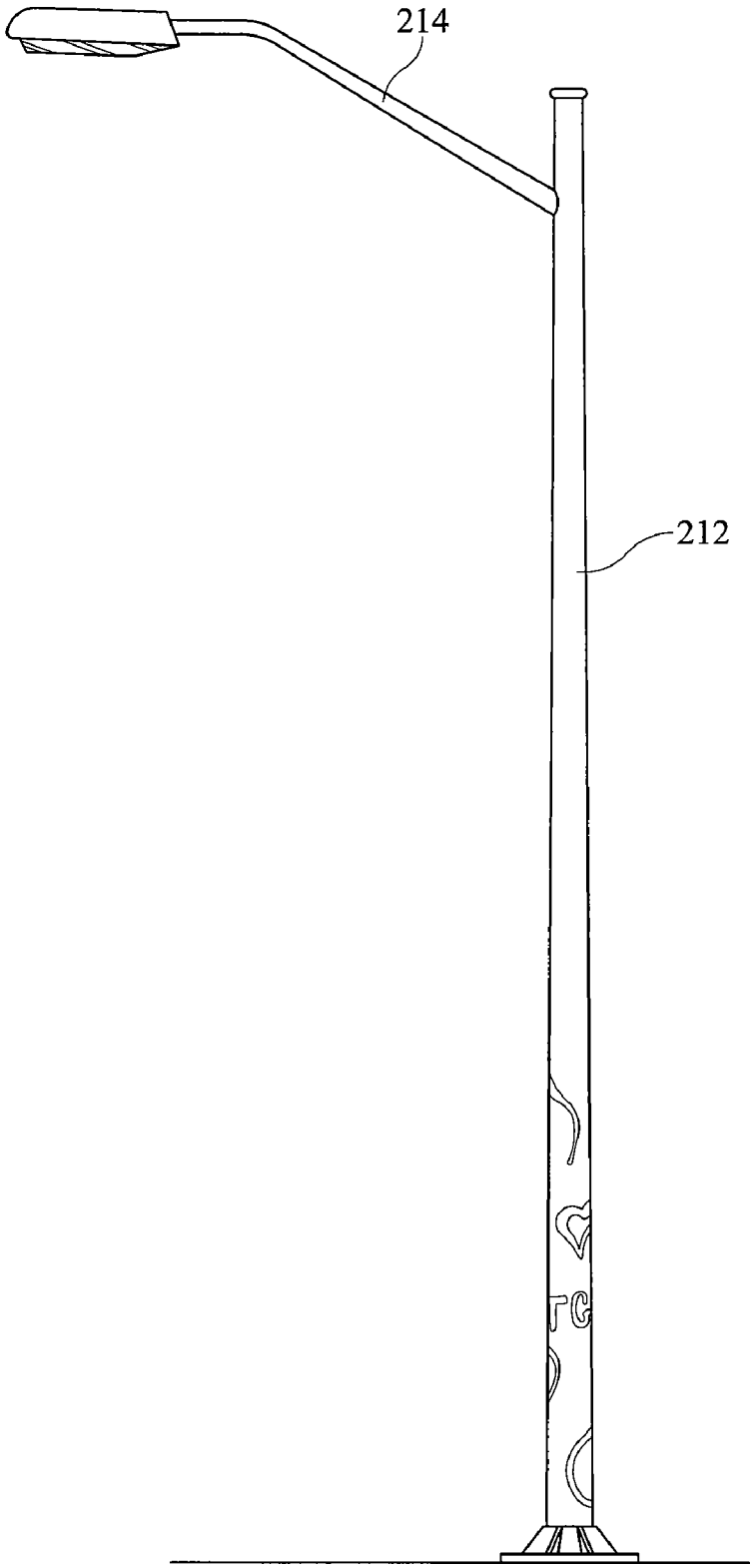
FIG. 13 is an elevation view of a prior art light post with graffiti painted thereon.

Referring now to FIG. 13, an outdoor lighting fixture is depicted for a street or parking lot area lighting. The light post is depicted with graffiti painted symbols and indicia along the vertical portion thereof. Graffiti indicia and symbols are undesirable on such lighting structure and are detrimental to the appearance of the fixture, post structure and area surrounding the lighting structure. The lighting structure generally comprises a support pole 212, a fixture arm 214 extending from an upper portion of the support pole 212 and a fixture disposed at an end of the fixture support arm 214 distal from the support pole 212. The support pole 212 may comprise various materials, known to one skilled in the art such as aluminum, steel, fiberglass, or other metals or composites.

Figure 14:
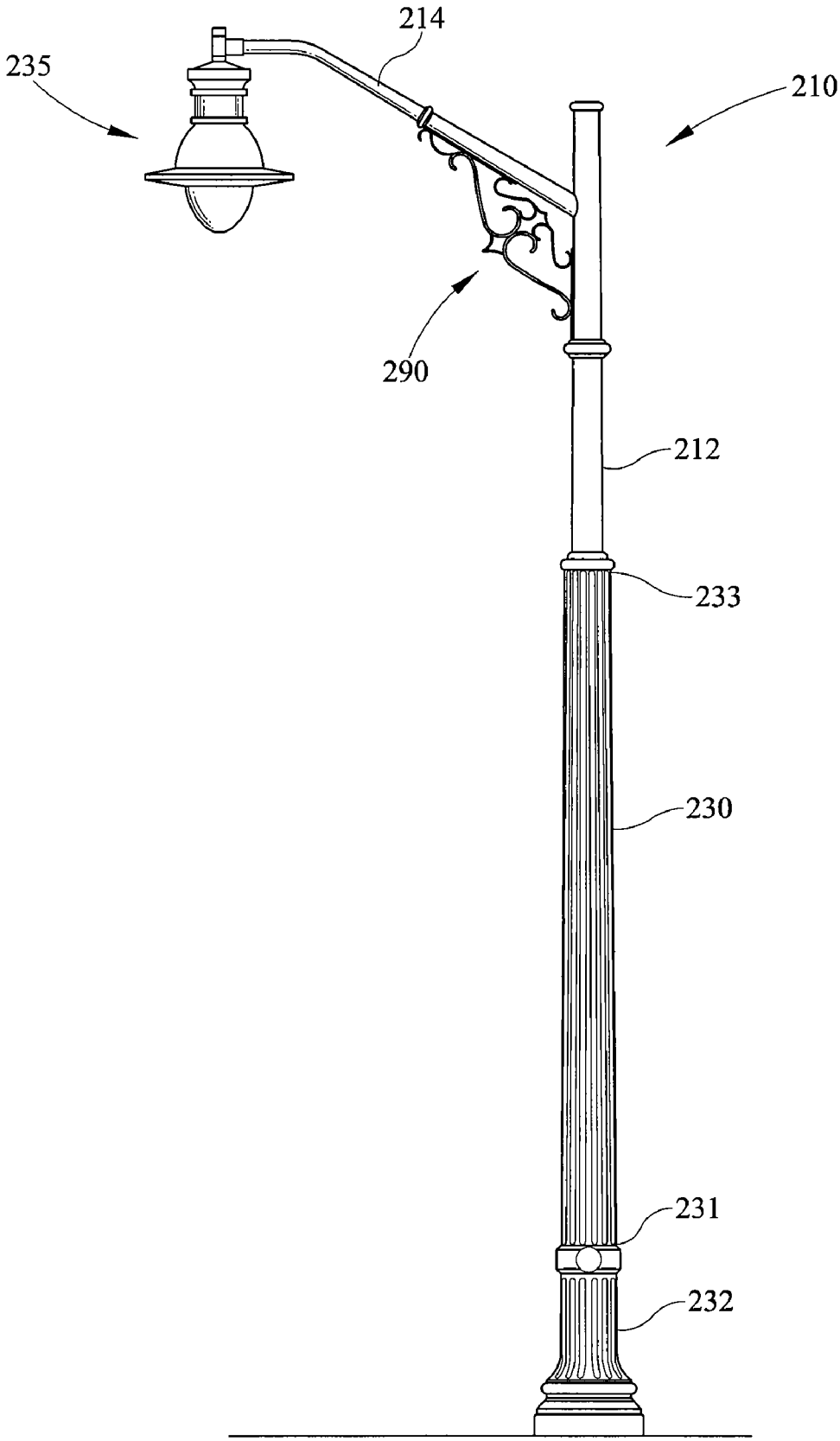
FIG. 14 is an elevation view of the support pole and an alternative slip over cover design.

Referring now to FIG. 14, a modular pole retrofit system 210 is depicted on the lighting structure depicted in FIG. 13. The retrofit system 210 of FIG. 14 provides an alternative to the cast aluminum products which are generally utilized in existing lighting poles and fixtures, such as the one shown in FIG. 13. The retrofit system 210 provides a slipover design for use with existing light poles or structures and comprises a no-maintenance finish since a color is molded throughout the product. The material is generally a high density polyethylene (HDPE) which can withstand high impact and temperature extremes, however it is within the scope of the present invention that alternative materials may be utilized. Further, the exemplary material is 100% recyclable and non-conductive such that the retrofit system 210 eliminates electrical shock hazards. Further, the high density polyethylene is resistant to salt, chemicals, fertilizers and other harsh environments.

Still referring to FIG. 14, the retrofit modular pole system 210 is positioned on the support pole 212 and depending from the fixture arm 214. The support pole 212 and fixture arm 214 should be understood by one skilled in the art to be existing structure on the light post such as the one shown in FIG. 13 and therefore the retrofit system 210 is utilized with the existing structure. Further, one skilled in the art should also understand that a lighting system may alternatively be utilized which does not comprise a fixture support arm but instead comprises a fixture at an upper end of the support pole 212. However, for clarity of description, the present embodiment is described as including the fixture support arm 214 and a fixture 235 disposed at a distal end of the fixture support arm 214.

The modular pole system 210 comprises a sleeve 230 disposed over the support pole 212. The sleeve 230 extends upwardly from a base cover 232. The first end of the sleeve 231 abuts the base cover 232 and the second end 233 is located at some position between the upper end and lower end of the support pole 212. The sleeve 230 of the present embodiment has a length which generally does not extend to an upper end of the support pole 212. Alternatively stated, the support pole 212 extends beyond the upper end of the sleeve 230. Between the fixture support arm 214 and support pole is a lattice 290. At an end of the fixture support arm 214 distal from the support pole 212 is a retrofit fixture 235.

Figure 15:
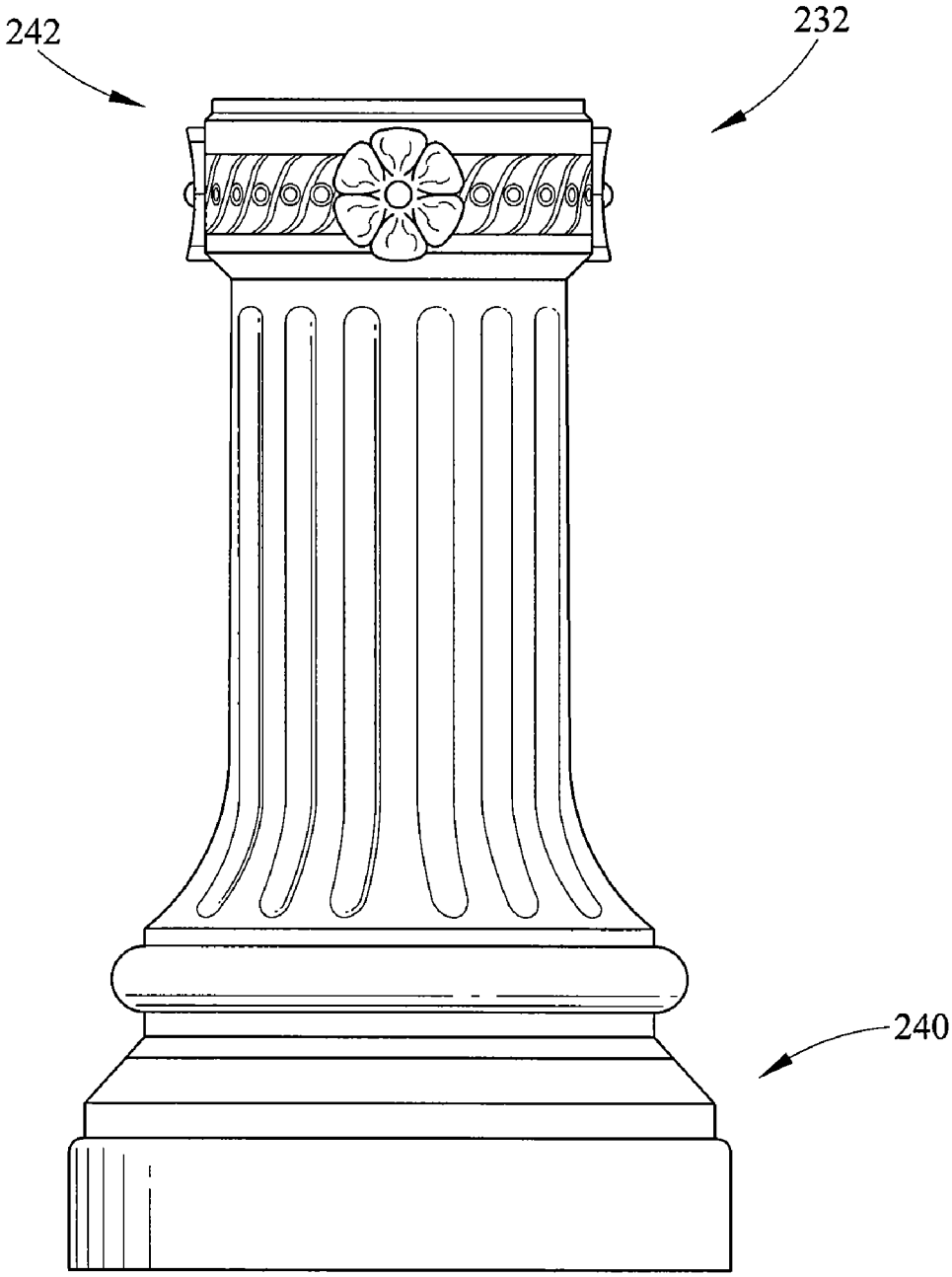
FIG. 15 is a side view of the base cover of the present invention.

Referring now to FIG. 15, the base cover 232 is depicted having a first end 240 with a larger diameter than a second end 242. Between the first end and second end 240, 242 of the base cover 232 are a plurality of decorative flutes which extend from the smaller diameter at the upper portion of the base cover 232 and extend downwardly and outwardly to a second diameter near the lower end of the base cover 232. The decorative fluted design provides an attractive decorative appearance as well as strengthening the base cover 232 and thereby making the base cover 232 impact resistant. The upper and lower ends 240, 242 may also be decorated as well as thickened in order to increase strength and rigidity of the design. The larger first end 240 of the base cover 232 provides a decorative cover for a base structure or lower components of the support pole 212. Specifically, the support pole (not shown) may be welded to a base plate (not shown), direct buried into the ground substrate or may extend through other structure utilized to maintain the support pole 212 in an upright position. Accordingly, the base cover 232 has a larger first end 240 which allows the base cover 232 to cover various types of connections between the support pole 212 and the substrate below.

Figure 16:
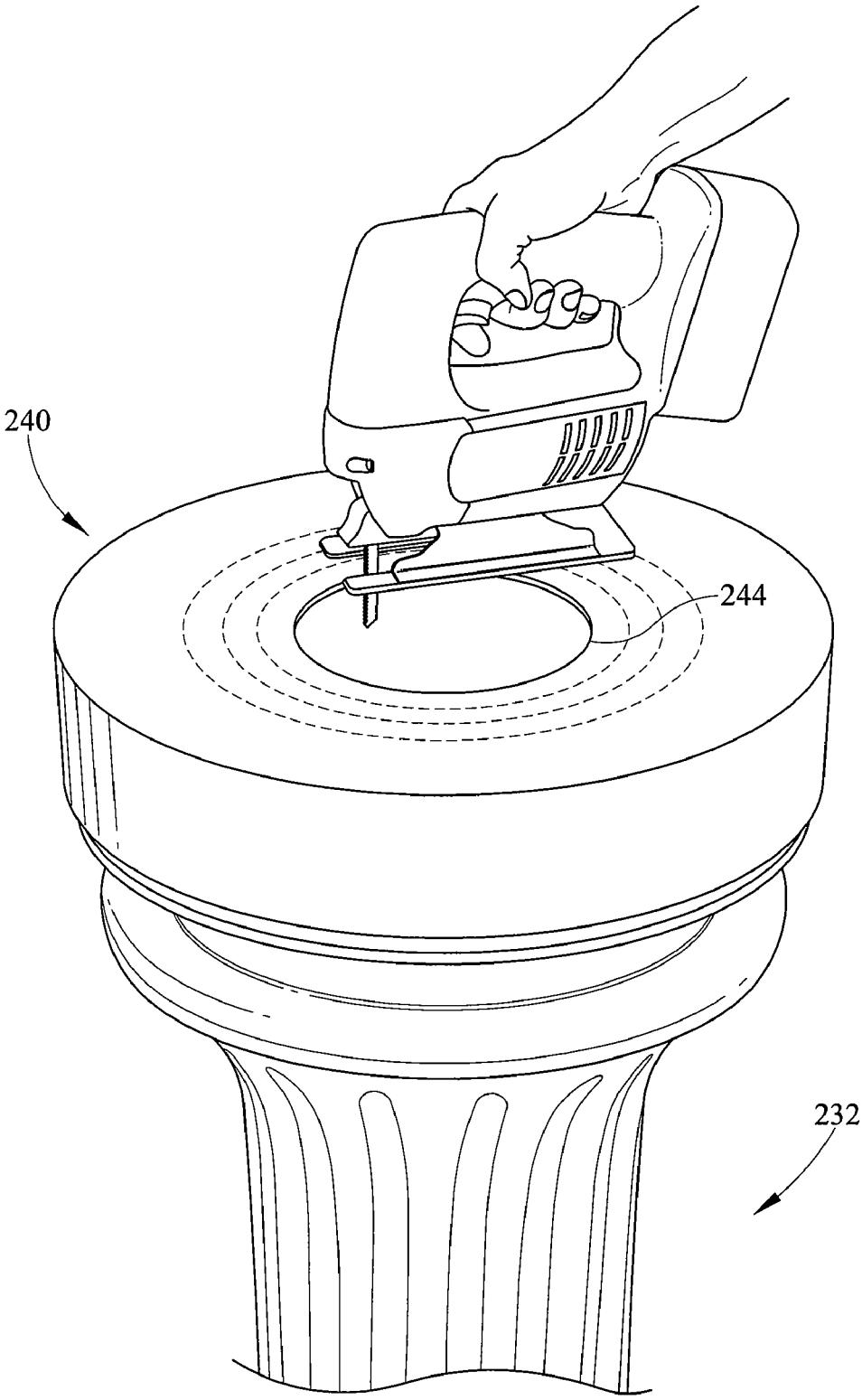
FIG. 16 is a perspective view of the lower surface of the base cover being prepared for installation.
Figure 17:
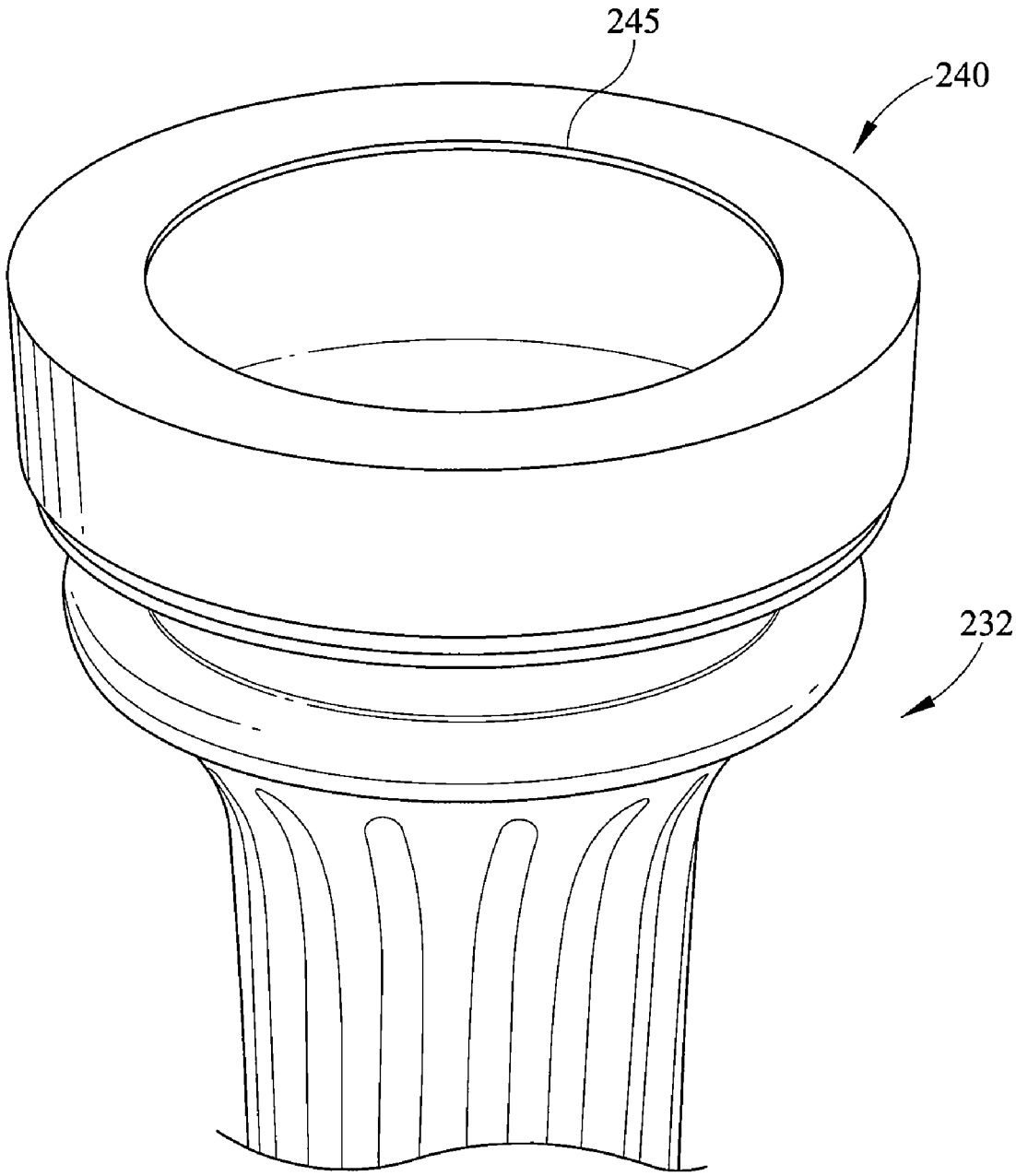
FIG. 17 is a perspective view of the lower surface of the base cover after preparation for installation.

Referring now to FIG. 16, the base cover 232 is shown disposed in an upside down position so that the first end 240 is directed upwardly. A starter aperture 244 is molded into the first end 240 of the base cover 232. Upon measuring the support pole connections and determining a minimum footprint opening required to slide the base cover 232 over such connection footprint between the support pole 212 and, for example, substrate, base plate, concrete pad or other light post footing design, the starter aperture 244 is cut to the appropriate size to increase the opening and allow the base cover 232 to be disposed over such connection footprint. Further, the starter aperture 244 may be surrounded by a plurality of perforations defining larger openings of various shapes, for example circular or square, to ease the enlargement of starter aperture 244. As depicted in FIG. 16, the first end 240 of the base cover 232 is cut using an electric jigsaw to a size which is appropriate for the exemplary installation. The HDPE material allows for easy cutting with a jigsaw, however various cutting tools may be utilized. Further, it should be understood that it is well within the scope of the present invention that the starter aperture 244 may be molded to an appropriate preselected size such that the cutting process is not required and so that the base cover 232 can be immediately installed into a position to cover any connection footprint defined between the support pole 212 and a substrate, base plate, concrete foot or the like. As shown in FIG. 17, the starter aperture 244 is enlarged following the cutting process. Alternatively, FIG. 17 may represent a molded aperture of preselected size. In any event, the aperture 245 is sized for installation.

Figure 18:
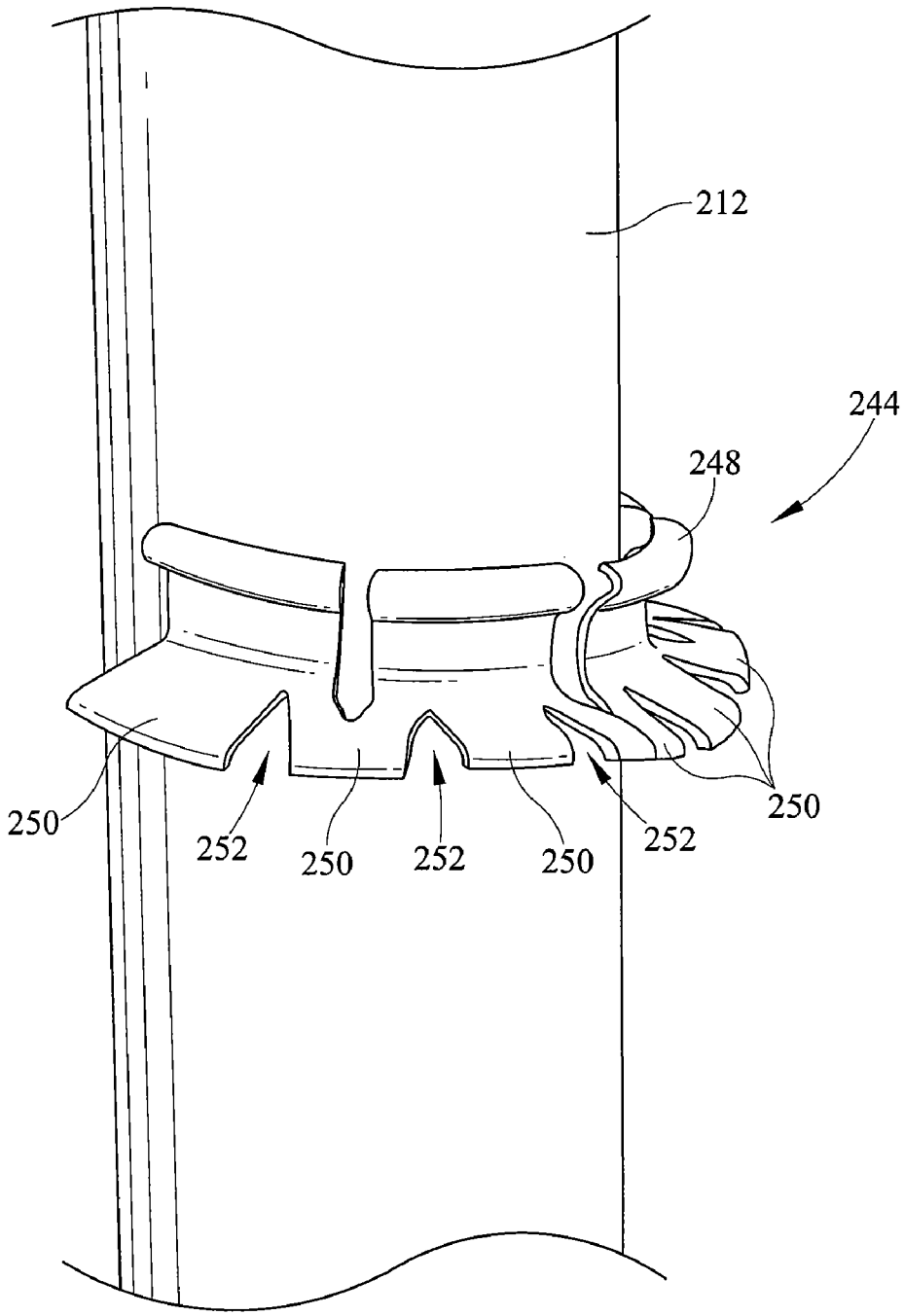
FIG. 18 is a side perspective view of the support pole with an anti-rotational device being installed.
Figure 19:
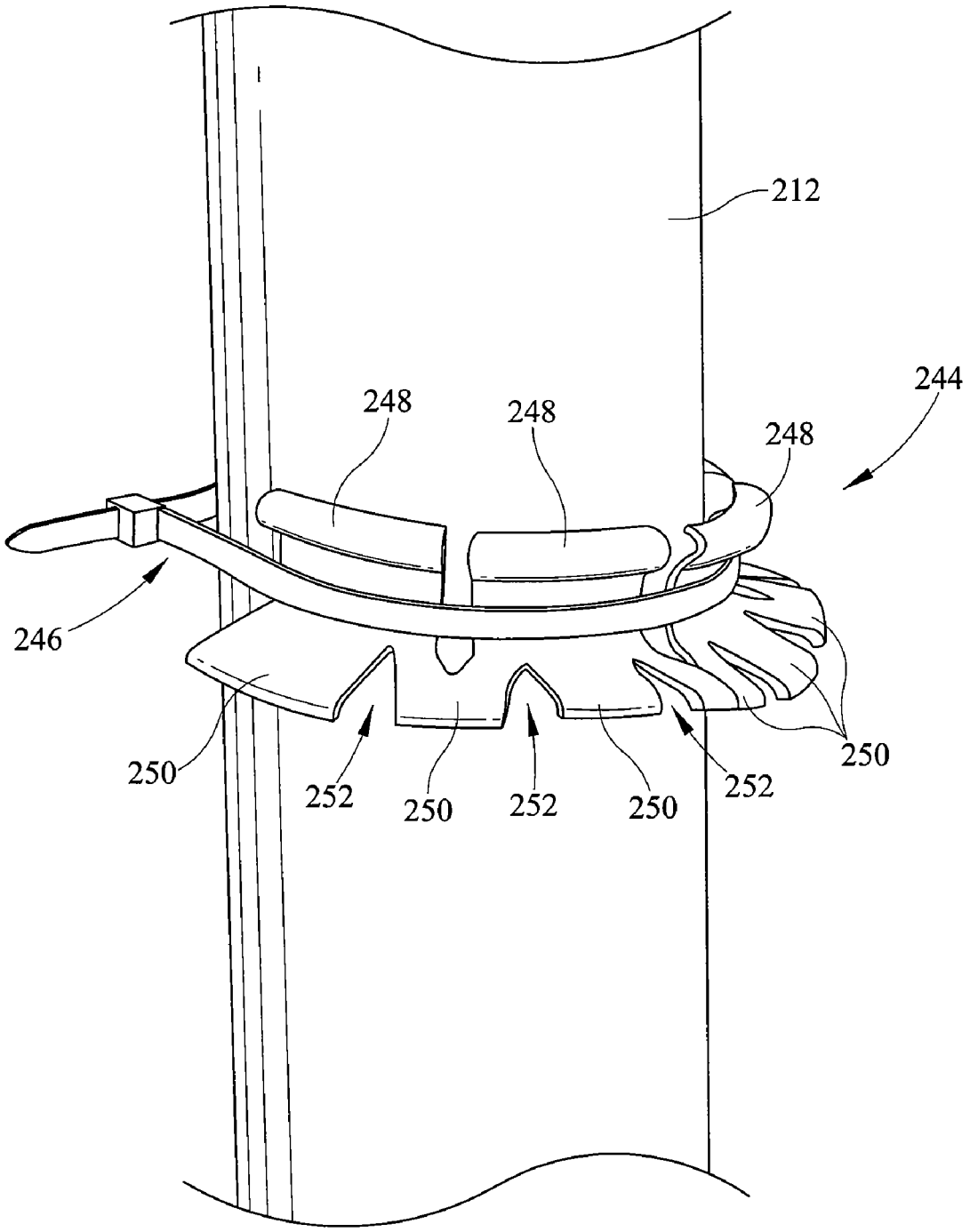
FIG. 19 is a side perspective view of the support pole with a fastener being installed on the anti-rotational device.

Referring now to FIG. 18, a side perspective view of a portion of the support pole 212 is depicted. Disposed about the support pole 212 is an anti-rotational device or spacer 244. Although an exemplary spacer 244 is depicted in the drawings, it is well within the scope of this invention that alternative shapes may be utilized. The exemplary spacer 244 is generally circular in shape having an upper shoulder 248 which engages the support pole 212. The lower end of the spacer 244 has a plurality of fingers 250 which extend radially outward from the spacer 244 to engage the inner surface of the sleeve 230 and inhibit rotation of the sleeve 230. The fingers 250 are defined by a plurality of notches 252 extending about the spacer 244 and between the fingers 250. The notches 252 allow the fingers to fold downwardly as the sleeve 230 is disposed over the spacer 244 without causing failure or deformation of the spacer 244. The spacer 244 is located at some pre-selected distance from the lower end of the support pole 212 and at a position below the upper end of the sleeve 230. Accordingly, the spacer 244 inhibits rotation of the sleeve 230 about the support pole 212 and centers the sleeve 230 about the support pole 212 as well. The spacer 244 is generally circular in shape with a central diameter. The spacer 244 may also be cut or discontinuous at some position about its circumference so that the spacer 244 may be spread apart about the outer surface of the support pole 212 rather than requiring the spacer 244 to be applied from the top of the support pole 212. Alternatively, one skilled in the art will realize that the spacer 244 may be a continuous circle and therefore slidably moved along the support pole 212 from the upper end. As a further alternative, one skilled in the art will further realize that the spacer 244 may be formed of two connectable semicircular portions. As shown in FIG. 19, once the spacer 244 is disposed on the support pole 212 at the pre-selected position, the spacer 244 is fastened on the support pole 212 with a fastening device 246. The fastener 246 is depicted as a tie wrap however, various alternative fastening devices may be utilized to permanently position the spacer 244 relative to the support pole 212.

Figure 20:
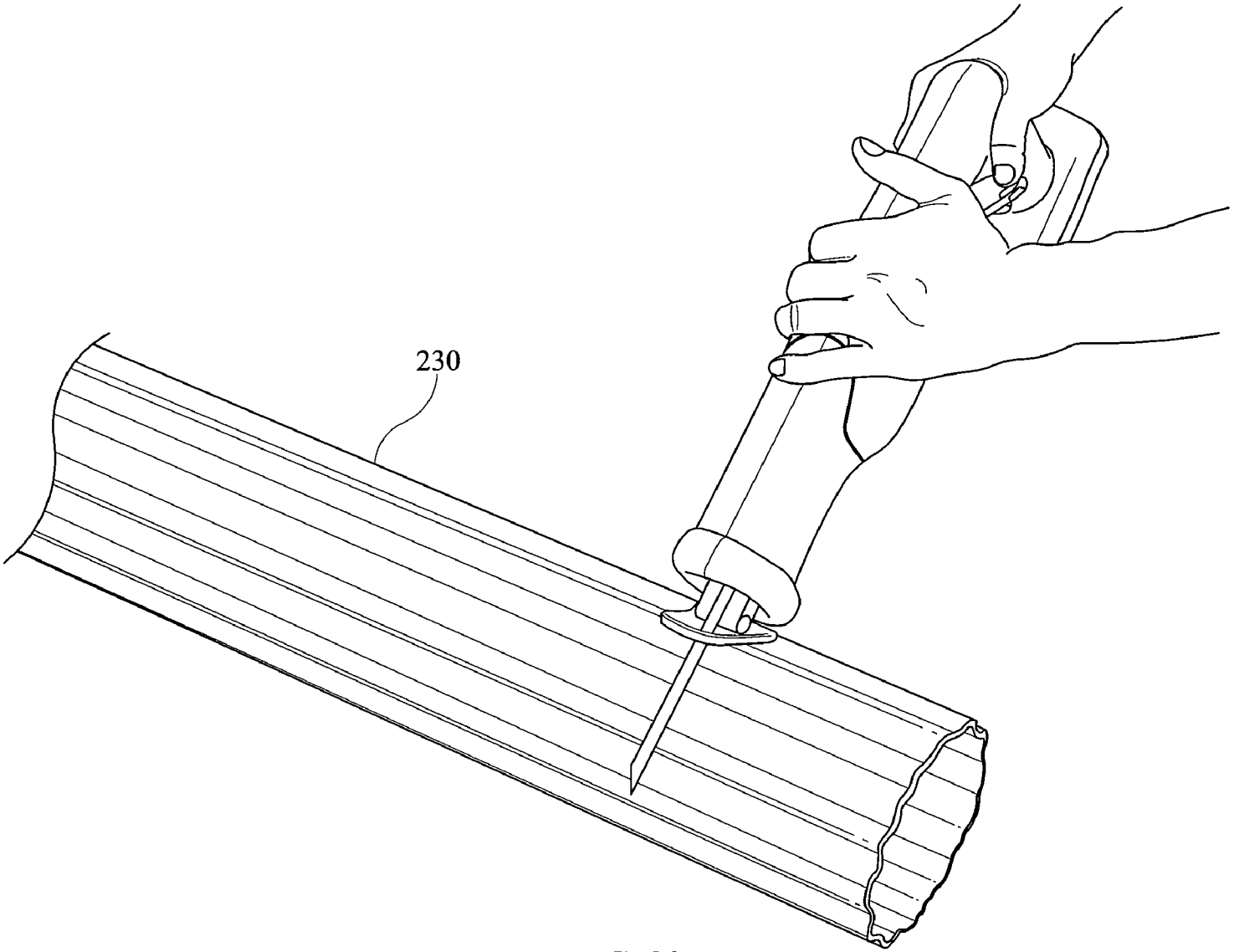
FIG. 20 is a perspective view of the sleeve being cut to length for installation.

Referring now to FIG. 20, a perspective view of the sleeve 230 is depicted. The sleeve 230 comprises a plurality of flutes extending about the outer surface of the structure. The flutes provide a strengthening structure to the sleeve design. In addition, the flutes provide contact points and surfaces along the inner surface of the sleeve 230 which engage the fingers 250 (FIGS. 18, 19) of the spacer 244 (FIGS. 18, 19). The sleeve 230 is depicted being cut to a pre-selected length. Once the sleeve 230 is cut to the pre-selected length, the sleeve 230 is disposed over the pole 212. The sleeve 230 has a wall thickness of about 3/16 inch but the thickness may vary depending on the strength of the material used.

Figure 21B:
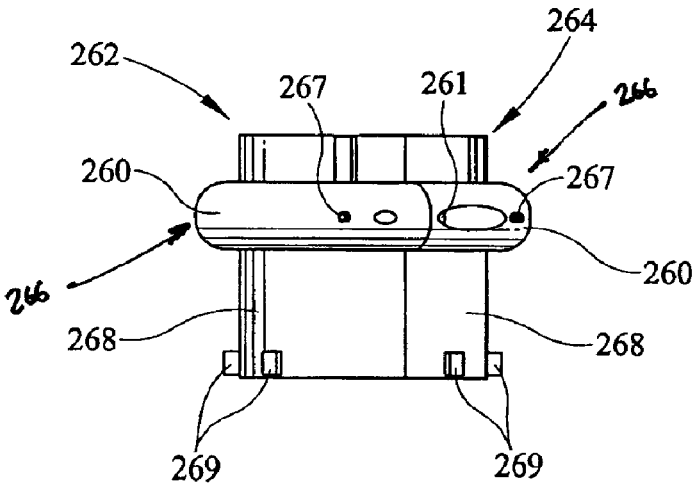
FIGS. 21A-B are side elevation views of the sleeve and sleeve cap being installed on the support pole.
Figure 21A:
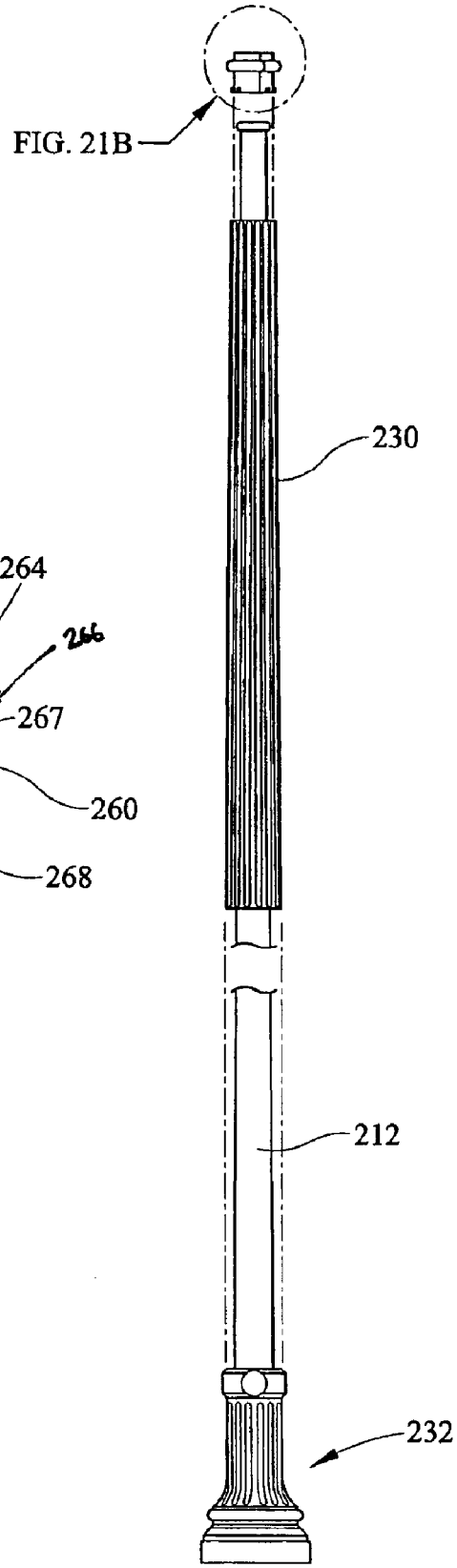
Figure 22:
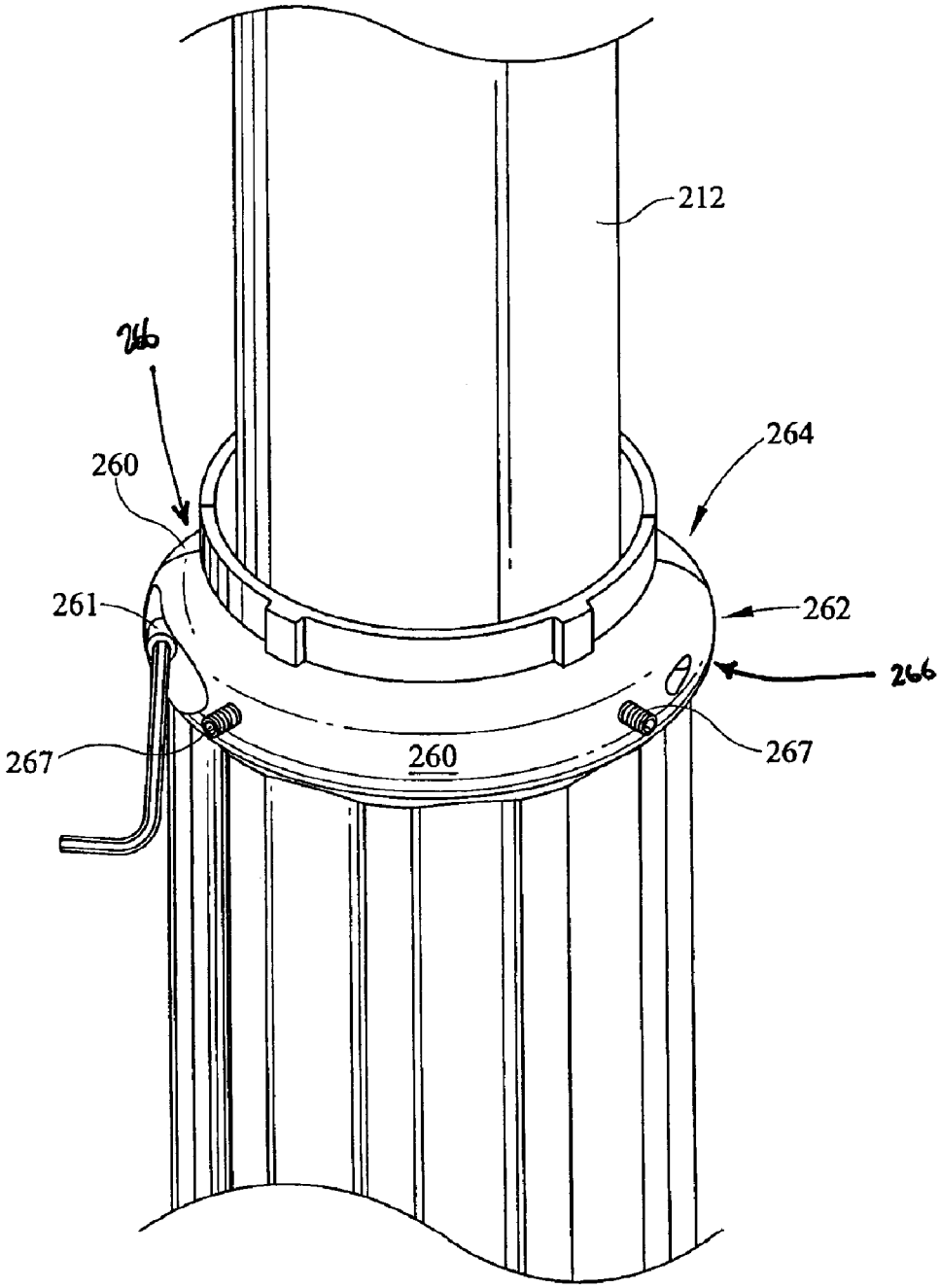
FIG. 22 is a perspective view of the installation of the sleeve cap.

Referring now to FIGS. 21 and 22, an exploded view of the assembly of the sleeve 230 and a sleeve cap 260 is depicted over the support pole 212 as well as a perspective view of the assembled sleeve cap 260. Depending on the type of the lighting structure being retrofit a fixture arm 214 (FIGS. 13, 14) may need to be removed to position the sleeve 230 over the support pole 212. The sleeve cap 260 is formed of semi-circular portions 262, 264 which abut one another and are fastened together about the outer surface of the support pole 212 by clamping screws 261. Each semi-circular portion 262, 264 further comprises a donut portion 266 having a plurality of set screws 267 to tighten and center the sleeve cap 260 around the pole 212. Depending from a lower portion of each donut 266 is a leg 268 which is disposed within the sleeve 230. At a lower portion of the leg 268 are a plurality of feet 269 which engage the inner surface of the sleeve 230 and thereby further inhibit rotation of the sleeve 230.

The sleeve cap 260 is fully positioned within the sleeve 230 and the clamping screws 261 on each of the first and second portions 262, 264 are tightened. Once the clamping screws 261 are tightened, the set screws 267 which are circumferentially disposed about the donut portion 266, are also tightened to center the sleeve cap 260 about the pole 212 and further aid to center the sleeve 230 about the support pole 212. Once positioned, the sleeve cap 260 captures the sleeve 230 between the cap 260 and base cover 232 and inhibits upward movement of either the sleeve 230 or base cover 232.

Figure 23:
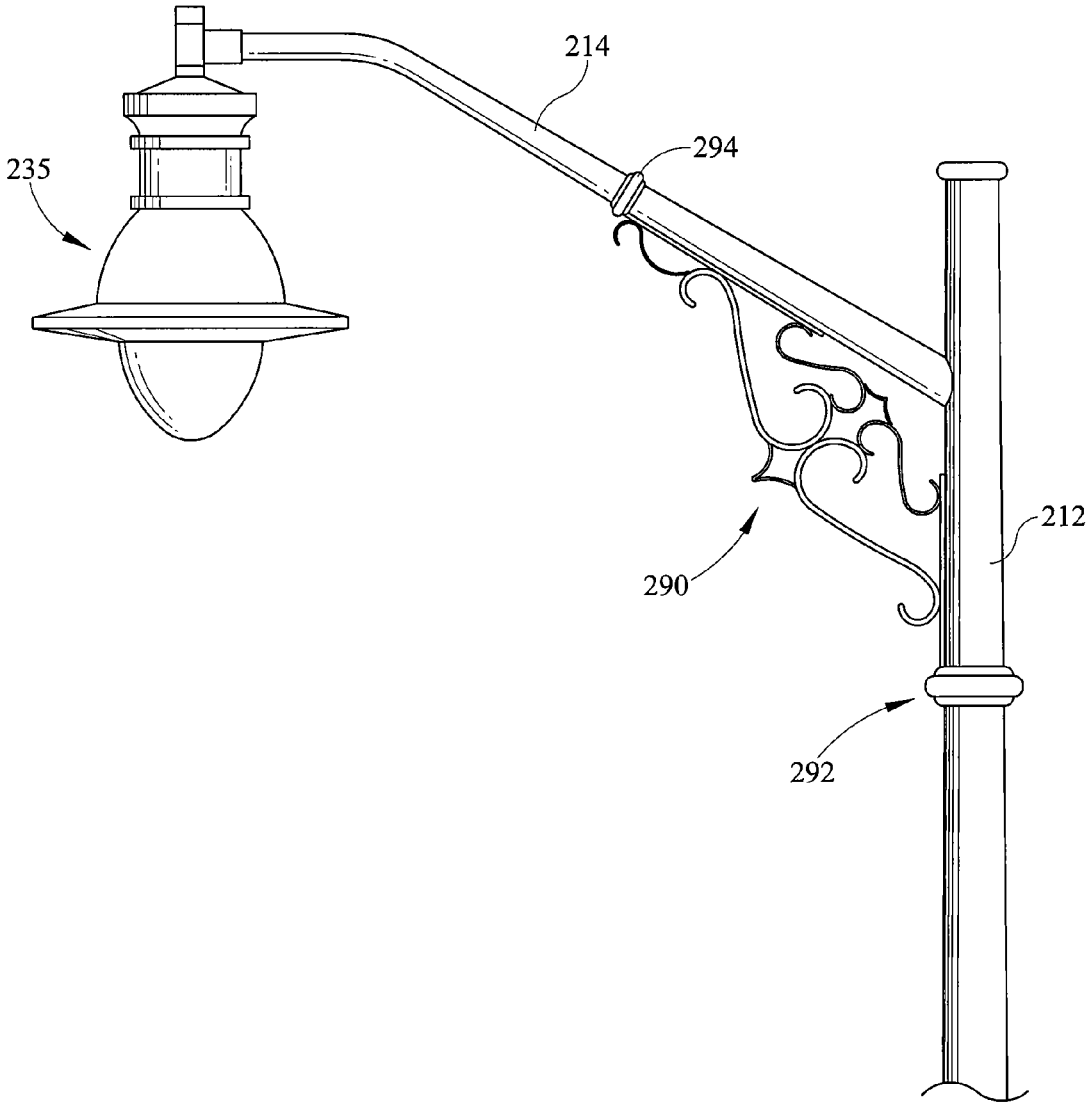
FIG. 23 is a side view of the upper portion of the support pole and lattice.

Referring now to FIG. 23, the upper portion of the pole sleeve 212 is depicted. Extending from the upper portion of the pole sleeve 230 is the fixture support arm 214 which is angled slightly upwardly in the exemplary embodiment. However, the fixture support arm 214 may alternatively be angled downwardly or extend substantially horizontal from the support pole 212. The Figure further depicts the connection between the lattice 290 and the support pole 212. The lattice 290 has a first end with a clamping device 292 connected to the support pole 212. At a second end of the decorative lattice 290 is a second clamp 294 which is connected to the fixture support arm 214. It should be noted that the lattice 290 may be connected to one of the support pole 212 or fixture support arm 214 only or may be connected to both by alternative connections such as screw fasteners, adhesives or the other fastening structures or devices. Further, it should be noted that the fixture support arm 214 is depicted as a substantially straight arm however, the fixture support arm 214 may be a curved arm which provides an alternative spaced arrangement between the fixture 235 and the support pole 212. Once the lattice 290 is connected to the support pole 212 and fixture support arm 214, the fixture 235 may be electrically wired and mechanically connected to the fixture support arm 214. The fixture 235 provides a more aesthetically pleasing look to the retrofit modular pole system 210. By comparing the light fixture of FIG. 13 with the fixture 235 of FIG. 14 and FIG. 23, one skilled in the art will realize that the fixture 235 has been dramatically changed to provide a rigid yet aesthetically pleasing design which reduces problems associated with graffiti and aging fixtures.

Many varying constructions may be utilized in order to compose the modular pole system and light fixture of the present invention. The internal skeleton and external shell disclosed herein provides for a simplistic mechanism for installing a plastic shell assembly over the top of an internal skeletal structure. Various modification may also be made to the internal skeletal structure to provide the same functionality disclosed. Such modifications fall within the teachings set forth within this disclosure. Any such modifications either to the internal skeletal structure, base and pole design in addition to the external shell while performing similar functionality are felt to fall within the teachings herein and no unnecessary limitations are to be construed by the specific embodiments and examples disclosed.

The invention claimed is:

1. A slip-over pole sleeve assembly, comprising:

a support pole;

a fixture arm extending from an upper portion of said support pole;

a fixture depending from said fixture arm;

a base cover positioned over a lower portion of said support pole adjacent a lower substrate;

a spacer positioned engaging said support pole along a length of said support pole;

a sleeve extending around said pole and engaging an upper edge of said base cover said sleeve having a length extending partially upwardly along said support pole to a position short of said fixture arm;

said spacer further engaging an inner surface of said sleeve and inhibiting movement of said sleeve;

said spacer having a shoulder and a plurality of fingers extending radially outward from said shoulder;

a notch separating each of said fingers;

a sleeve cap engaging an upper edge of said sleeve.

2. The slip-over pole sleeve assembly of claim 1 further comprising a decorative lattice having a first end and a second end.

3. The slip-over pole sleeve assembly of claim 2, said first end of said lattice connected to said fixture arm and said second end of said lattice connected to said support pole.

4. The slip-over pole sleeve assembly of claim 2, said sleeve cap comprising a plurality of set screws which engage said support pole.

5. The slip-over pole sleeve assembly of claim 2, said sleeve cap extending into an upper portion of said sleeve between said sleeve and said support pole.

6. The slip-over pole sleeve assembly of claim 1 further comprising a lattice connected to said support pole.

7. The slip-over pole sleeve assembly of claim 1 further comprising a lattice connected to said fixture arm.

8. A retro-fit lighting system, comprising:

a pole having a base plate at one end;

said pole disposed in a substantially upright orientation;

a base cover disposed over said base plate and around said pole;

at least one spacer positioned along said pole;

a sleeve disposed over said pole, above said base cover and engaged by said at least one spacer;

said sleeve having a length at least about half the length of said pole;

said at least one spacer is attached to said pole by a tie-wrap.

* * * * *